US010001308B2

(12) United States Patent
Shimazu

(10) Patent No.: US 10,001,308 B2
(45) Date of Patent: Jun. 19, 2018

(54) REFRIGERATION CYCLE DEVICE

(75) Inventor: Yusuke Shimazu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 582 days.

(21) Appl. No.: 14/361,314

(22) PCT Filed: Dec. 22, 2011

(86) PCT No.: PCT/JP2011/007209
§ 371 (c)(1),
(2), (4) Date: May 29, 2014

(87) PCT Pub. No.: WO2013/093981
PCT Pub. Date: Jun. 27, 2013

(65) Prior Publication Data
US 2014/0298842 A1 Oct. 9, 2014

(51) Int. Cl.
*F25D 17/06* (2006.01)
*F25B 49/02* (2006.01)
(Continued)

(52) U.S. Cl.
CPC ..... *F25B 49/02* (2013.01); *F25B 9/006* (2013.01); *F25B 49/005* (2013.01); *F25B 2400/08* (2013.01); *F25B 2500/19* (2013.01)

(58) Field of Classification Search
CPC ..... F25B 15/00; F25B 17/00; F25B 49/02; F25B 49/005; F25B 9/006; F25B 2400/08; F25B 2500/19
See application file for complete search history.

(56) References Cited

U.S. PATENT DOCUMENTS 5,626,026 A * 5/1997 Sumida ..... F25B 9/006 62/129
5,737,931 A * 4/1998 Ueno ..... F25B 9/006 62/126
(Continued)

FOREIGN PATENT DOCUMENTS

CN 1208841 A 2/1999
JP 07-012411 A 1/1995
(Continued)

OTHER PUBLICATIONS

Office Action dated May 28, 2015 in the corresponding CN application No. 201180076284.7 ( English translation attached).
(Continued)

*Primary Examiner* — David Teitelbaum
*Assistant Examiner* — Kamran Tavakoldavani
(74) *Attorney, Agent, or Firm* — Posz Law Group, PLC

(57) ABSTRACT

A refrigeration cycle device circulates a refrigerant, which is a zeotropic refrigerant mixture. In a refrigeration cycle, a compressor, a condenser, an expansion valve, and an evaporator are connected by a refrigerant pipe. The refrigeration cycle device calculates a circulation composition value of the refrigerant based on states before and after the refrigerant temperature and the refrigerant pressure change during the operation of the refrigeration cycle, calculates dT for calibrating a second temperature sensor and dP for calibrating a pressure sensor, based on a reference composition value and the circulation composition value of the refrigerant, corrects the value of the temperature of the refrigerant on an outlet side based on dT, corrects the value of the pressure of the refrigerant based on dP, and operates the refrigeration cycle.

14 Claims, 7 Drawing Sheets

(51) Int. Cl.
*F25B 9/00* (2006.01)
*F25B 49/00* (2006.01)

(56) References Cited

U.S. PATENT DOCUMENTS

| | | | | |
|---|---|---|---|---|
| 5,996,358 | A | 12/1999 | Sumida et al. | |
| 6,192,696 | B1 | 2/2001 | Shimamoto et al. | |
| 6,247,320 | B1 | 6/2001 | Sumida et al. | |
| 8,911,641 | B2 * | 12/2014 | Low | B60H 1/3204 134/36 |
| 2006/0086110 | A1 * | 4/2006 | Manole | F25B 1/10 62/175 |
| 2007/0240440 | A1 * | 10/2007 | Sunderland | F25B 49/022 62/228.3 |
| 2010/0107681 | A1 * | 5/2010 | Morimoto | F24F 1/0059 62/498 |

FOREIGN PATENT DOCUMENTS

| | | | |
|---|---|---|---|
| JP | 08-075280 | A | 3/1996 |
| JP | 08-136078 | A | 5/1996 |
| JP | 09-068356 | A | 3/1997 |
| JP | 11-063747 | A | 3/1999 |
| JP | 11-182951 | A | 7/1999 |
| JP | 2002-213845 | A | 7/2002 |
| JP | 2005-106380 | A | 4/2005 |

OTHER PUBLICATIONS

International Search Report of the International Searching Authority dated Feb. 14, 2012 for the corresponding international application No. PCT/JP2011/007209 (and English translation).
Office Action dated Jan. 6, 2015 issued in corresponding JP patent application No. 2013-549961.
Office Action dated Jul. 20, 2017 issued in corresponding GB application No. 1409527.7.

* cited by examiner

REFRIGERATION CYCLE DEVICE

CROSS REFERENCE TO RELATED APPLICATION

This application is a U.S. national stage application of International Application No. PCT/JP2011/007209 filed on Dec. 22, 2011, the disclosure of which is incorporated by reference.

TECHNICAL FIELD

The present invention relates to a refrigeration cycle device and, more particularly, to detection of a circulation composition in a refrigeration cycle.

BACKGROUND ART

A conventional refrigeration cycle device includes a compressor, a condenser, a decompressor, and an evaporator, and a refrigeration cycle is formed by connecting the components via a refrigerant pipe. In general, in a refrigeration cycle device adopting a zeotropic refrigerant mixture, since the boiling points of refrigerants contained in the zeotropic refrigerant mixture are different from one another, the composition of the circulating refrigerant may change. In particular, in the case where the refrigeration cycle device has a large scale, a significant change in the refrigerant composition occurs. That is, when the refrigerant composition changes, even under the same pressure condition, there is a possibility that the condensing temperature or the evaporating temperature may change. In the case where the refrigerant composition changes, an appropriate refrigerant saturation temperature cannot be obtained in a heat exchanger. Thus, it becomes difficult for the refrigerant to condense and liquefy or to evaporate and gasify in the heat exchanger. As a result, there is a possibility that the heat exchange efficiency may reduce.

Furthermore, when the refrigerant composition changes, even if the refrigerant outflow side of the heat exchanger has the same temperature and the same pressure, there is a possibility that the degrees of superheat and subcooling may change. That is, since an adequate degree of superheat is not achieved before suction into the compressor, a liquid refrigerant flows into the compressor. Since the density per volume of a liquid refrigerant is higher than that of a gas refrigerant, when the compressor is about to compress the liquid refrigerant, an excess driving torque is applied to the compressor. Thus, the compressor may be damaged by the application of such an excess torque.

Furthermore, since an adequate degree of subcooling is not achieved before flowing into an expansion valve, the refrigerant may turn into a two-phase gas-liquid refrigerant. As a result, there is a possibility that refrigerant noise may occur at the expansion valve or an instability phenomenon of the refrigerant may occur.

Therefore, as a configuration for reducing the variation range of a refrigerant composition circulating in a refrigeration cycle device, a refrigeration cycle device which includes a refrigerant reservoir on a high-pressure side (for example, a receiver) is known. The variation range of a refrigerant composition circulating in the refrigeration cycle device is smaller in a refrigeration cycle device of the aforementioned type than in a refrigeration cycle device which includes a refrigerant reservoir on a low-pressure side (for example, an accumulator).

However, even with such a configuration, if refrigerant leakage occurs in the refrigeration cycle, the variation range of the refrigerant composition will increase, irrespective of whether the refrigerant reservoir is arranged on the low-pressure side or the refrigerant reservoir is arranged on the high-pressure side. This means, on the contrary, that refrigerant leakage can be detected by detecting a variation in the refrigerant composition.

Therefore, as a conventional refrigeration cycle device that includes means for detecting a refrigerant composition in order to suppress a reduction in heat exchange efficiency, avoid damage to a compressor, suppress generation of a refrigerant sound, suppress an instability phenomenon, and detect refrigerant leakage, the following configuration has been available. That is, in the conventional refrigeration cycle device, a bypass which is connected so as to allow bypassing of the compressor is formed, and the bypass includes a double-pipe heat exchanger and a capillary. The refrigeration cycle device detects the refrigerant inflow-side temperature of the capillary, the refrigerant outflow-side temperature of the capillary, and the refrigerant outflow-side pressure of the capillary, and calculates the refrigerant composition based on the detection results. Moreover, some of such refrigeration cycle devices include a bypass which allows bypassing of the compressor. In the bypass, a double-pipe heat exchanger and a capillary are connected. A temperature sensor is provided on the inlet side of the capillary, and a temperature sensor different from the temperature sensor provided on the inlet side and a pressure sensor are provided on the outlet side of the capillary.

Such a refrigeration cycle device obtains the refrigerant composition by circulating a zeotropic refrigerant mixture in the refrigeration cycle, detecting the temperatures and pressure of the zeotropic refrigerant mixture with the two temperature sensors and the pressure sensor described above, and identifying the detected temperatures and pressure with a composition relational expression of the refrigerant (see, for example, Patent Literature 1).

Furthermore, a conventional refrigeration cycle device includes a compressor, a four-way valve, a condenser, an expansion valve, and an evaporator, which are connected via a refrigerant pipe to form a refrigeration cycle. Moreover, some of such refrigeration cycle devices include a suction pressure sensor and a suction temperature sensor that are included in a suction pipe of a compressor, and detect the pressure of a refrigerant circuit on a low pressure side and the refrigerant temperature of the suction pipe (see, for example, Patent Literature 2).

The refrigeration cycle device of Patent Literature 2 calculates saturation pressure based on the refrigerant temperature detected by the suction temperature sensor, and corrects an output value of the suction pressure sensor based on a deviation of the pressure detected by the suction pressure sensor with respect to the saturation pressure.

CITATION LIST

Patent Literature

Patent Literature 1: Japanese Unexamined Patent Application Publication No. 11-63747 (paragraphs [0027] and [0036] to [0041], and FIGS. 1 and 5)

Patent Literature 2: Japanese Unexamined Patent Application Publication No. 2005-106380 (paragraphs [0014] to [0016] and FIG. 1]

SUMMARY OF INVENTION

Technical Problem

In the conventional refrigeration cycle device (Patent Literature 1), a zeotropic refrigerant mixture is supplied into the capillary, and the refrigerant composition is obtained based on states before and after the process of expansion of the zeotropic refrigerant mixture in the capillary. In such a process, at the outlet side of the capillary where the zeotropic refrigerant flows out, the zeotropic refrigerant mixture is in a two-phase state.

As a result, measurement errors in the temperature sensor on the outlet side and the pressure sensor on the outlet side have a considerable influence. Therefore, it is necessary to use a temperature sensor with high detection accuracy and a pressure sensor with high detection accuracy, which requires a high cost. Furthermore, even if the temperature sensor with high detection accuracy and the pressure sensor with high detection accuracy are assembled to the refrigeration cycle device, since variations reduce the detection accuracy, a high assembly cost is also required. Therefore, attempting to accurately detect the circulation composition in the refrigeration cycle causes an increase in cost.

Furthermore, the conventional refrigeration cycle device (Patent Literature 2) corrects an output value of the above-mentioned suction pressure sensor based on the above-mentioned suction temperature sensor. Therefore, the accuracy of the suction pressure sensor depends on the suction temperature sensor. Thus, the refrigeration cycle device does not correct an output value of the suction temperature sensor and an output value of the suction pressure sensor simultaneously.

In the case where the refrigerant that circulates in the refrigerant circuit of the refrigeration cycle device is a zeotropic refrigerant, even when the refrigeration cycle device is about to calculate the saturation pressure based on the refrigerant temperature detected by the suction temperature sensor, the correlation between the saturation temperature and the saturation pressure differs depending on the refrigerant quality. Therefore, when the circulation composition of the zeotropic refrigerant is unknown, an output value of the suction pressure sensor cannot be accurately corrected based on the refrigerant temperature. Furthermore, even if the circulation composition can be specified, since the refrigerant quality changes depending on the location where the suction temperature sensor is arranged, an output value of the suction pressure sensor cannot be accurately corrected based on the suction temperature sensor. Therefore, although such a refrigeration cycle device costs little, the circulation composition in the refrigeration cycle cannot be accurately detected.

As described above, the conventional refrigeration cycle devices (Patent Literatures 1 and 2) have a problem that attempting to accurately detect the circulation composition in the refrigeration cycle requires a high cost, whereas attempting to reduce the cost prevents the circulation composition in the refrigeration cycle from being accurately detected.

The present invention has been made to solve the above-mentioned problems, and has as its object to provide a refrigeration cycle device which costs little but nonetheless is capable of detecting a circulation composition in a refrigeration cycle more accurately than a conventional refrigeration cycle device.

Solution to Problem

A refrigeration cycle device according to the present invention that circulates a zeotropic refrigerant mixture through a refrigeration cycle in which a compressor, a condenser, an expansion valve, and an evaporator are connected by a refrigerant pipe, includes temperature detection means for individually detecting refrigerant temperatures on an inlet side and an outlet side of a portion in which the zeotropic refrigerant mixture discharged from the compressor is in a two-phase gas-liquid state; pressure detection means for detecting a refrigerant pressure on the outlet side; a detection control unit that calculates a circulation composition value of the zeotropic refrigerant mixture, based on values of the temperatures of the zeotropic refrigerant mixture detected by the temperature detection means and a value of the pressure of the zeotropic refrigerant mixture detected by the pressure detection means; a correction control unit that corrects at least one of the values of the temperatures of the zeotropic refrigerant mixture and the value of the pressure of the zeotropic refrigerant mixture, based on the circulation composition value calculated by the detection control unit; and a controller that drives the compressor. The detection control unit calculates a reference composition value, which is a reference circulation composition value, based on a filling composition of the zeotropic refrigerant mixture at the time of filling in the refrigeration cycle, and calculates a circulation composition value of the zeotropic refrigerant mixture, based on states before and after the values of the temperatures of the zeotropic refrigerant mixture and the value of the pressure of the zeotropic refrigerant mixture change during operation of the refrigeration cycle. The correction control unit calculates at least one of a temperature correction value for correcting a detection result obtained by the temperature detection means for detecting the refrigerant temperature on the outlet side and a pressure correction value for correcting a detection result obtained by the pressure detection means, based on the reference composition value and the circulation composition value of the zeotropic refrigerant mixture. The controller operates the refrigeration cycle by driving the compressor, based on a detection result obtained by the detection control unit after the correction by the correction control unit.

Advantageous Effects of Invention

The present invention can provide a refrigeration cycle device which costs little but nonetheless is capable of detecting a circulation composition within a refrigeration cycle more accurately than a conventional refrigeration cycle device, and thus provides a practical configuration that exhibits improved operational reliability during operation, since a refrigerant temperature and a refrigerant pressure detected when a circulation composition is obtained based on detection results are corrected to a refrigerant temperature and a refrigerant pressure that correspond to a reference composition value.

DESCRIPTION OF EMBODIMENTS

Embodiments of the present invention will be described in detail hereinafter with reference to the accompanying drawings.

Embodiment 1

Figure 1:
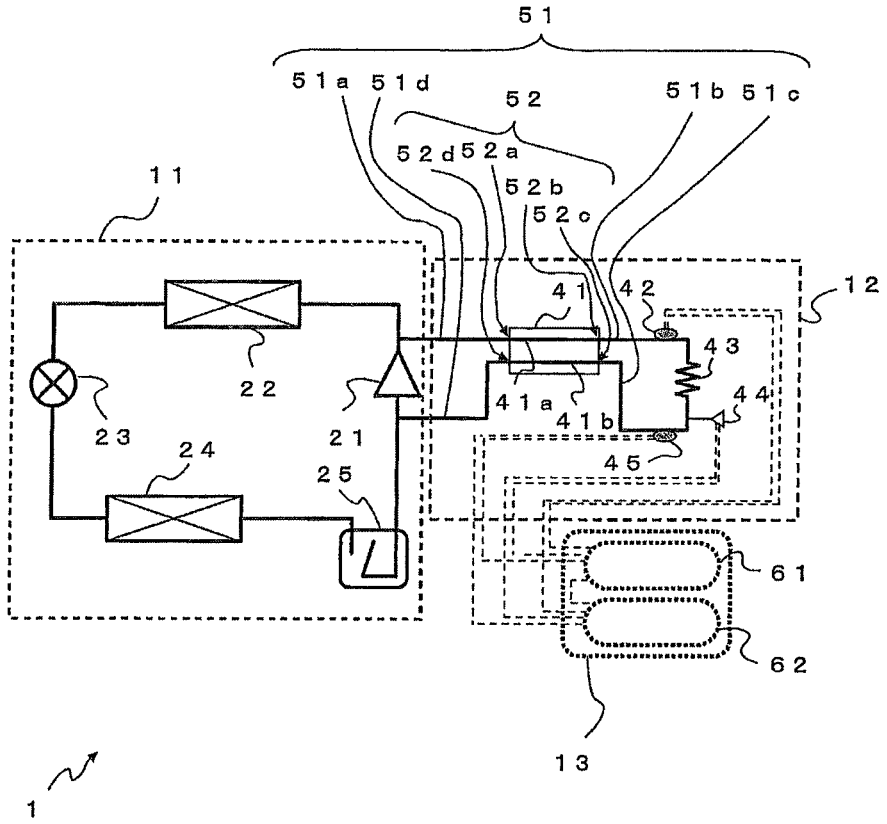
FIG. 1 is a diagram illustrating an example of a refrigerant circuit configuration of a refrigeration cycle device 1 according to Embodiment 1 of the present invention.

FIG. 1 is a diagram illustrating an example of a refrigerant circuit configuration of a refrigeration cycle device 1 according to Embodiment 1 of the present invention.

Note that in Embodiment 1 of the present invention, a zeotropic refrigerant mixture is adopted as a refrigerant in the refrigeration cycle device 1. The refrigeration cycle device 1 is configured to control various units such as the opening degree of an expansion valve 23 (to be described later) by detecting the refrigerant composition of the zeotropic refrigerant mixture. The refrigeration cycle device 1 described below costs little but nonetheless accurately detects the circulation composition in the refrigeration cycle.

In the following description, a refrigerant composition does not mean a refrigerant composition to be filled or a refrigerant composition which exists in each component of the refrigeration cycle. A refrigerant composition means a refrigerant composition circulating in the refrigeration cycle.

As illustrated in FIG. 1, the refrigeration cycle device 1 includes a refrigerant circuit 11, a composition detection circuit 12, and a controller 13. With organic operation of these components, the refrigeration cycle device 1 supplies cold air or the like into a room or the like (not illustrated), while improving the operational reliability during operation. The controller 13 will be described with reference to a block diagram.

Each configuration of the refrigeration cycle device 1 will be described next.

The refrigerant circuit 11 is configured to supply cold air or the like into the room or the like, and includes a compressor 21 which compresses a refrigerant, a condenser 22 which condenses and liquefies the refrigerant, an expansion valve 23 which decompresses and expands the refrigerant, an evaporator 24 which evaporates and gasifies the refrigerant, an accumulator 25 which stores an excess refrigerant, and the like. The refrigerant circuit 11 is configured by connecting these components by a refrigerant pipe.

As described above, a zeotropic refrigerant mixture is adopted in the refrigerant circuit 11. As a low-boiling-point refrigerant, R32, for example, is adopted. As a high-boiling-point refrigerant, a hydrofluoroolefin-based refrigerant, such as, HFO1234yf, is adopted. The filling composition of R32 is 44 (wt %) and the filling composition of HFO1234yf is 56 (wt %). Furthermore, in the case of the filling compositions, the global warming potential (GWP: Global Warming Potential) of the zeotropic refrigerant mixture is 300. The global warming potential mentioned here means a number representing the ability of a greenhouse effect gas different from carbon dioxide to contribute to warming with reference to that of carbon dioxide.

An example of the filling composition of the zeotropic refrigerant mixture has been explained above. Obviously, however, the filling composition is not limited to the foregoing example. That is, a zeotropic refrigerant mixture based on a different combination may be adopted. Needless to say, HFO1234ze, for example, may be adopted as a high-boiling-point refrigerant.

Each configuration of the refrigerant circuit 11 will be described next.

The compressor 21 is configured to suck a refrigerant, compress the refrigerant to a high-temperature high-pressure state, and discharge the high-temperature high-pressure refrigerant. The compressor 21 is, for example, a capacity-controllable inverter compressor. A discharge pipe (not illustrated) on a discharge side of the compressor 21 is connected to the condenser 22 via a refrigerant pipe. Furthermore, the discharge pipe on the discharge side of the compressor 21 is connected to a first port 52*a* (to be described later) of a high-and-low-pressure heat exchanger 41 (to be described later) via a first bypass pipe 51*a* (to be described later). A suction pipe (not illustrated) of the compressor 21 on the suction side is connected to the accumulator 25 via the refrigerant pipe. Moreover, the suction pipe of the compressor 21 on the suction side is connected to a fourth port 52*d* (to be described later) of the high-and-low-pressure heat exchanger 41 (to be described later) via a fourth bypass pipe 51*d* (to be described later).

The condenser 22 is configured to condense and liquefy, through a heat medium such as air, the high-temperature high-pressure refrigerant supplied from the compressor 21. The condenser 22 has its one end connected to the compressor 21 via the refrigerant pipe, and its other end connected to the expansion valve 23 via the refrigerant pipe. Note that an air-sending fan (not illustrated) is attached to the condenser 22. The air-sending fan promotes heat exchange between air supplied from the air-sending fan and the refrigerant flowing through the condenser 22. Due to the effect of the air-sending fan, the air which has exchanged heat with the refrigerant is discharged, for example, outside the room or the like.

The expansion valve 23 is configured to decompress and expand the liquid refrigerant that flows in from the condenser 22 to transform the refrigerant into a two-phase gas-liquid refrigerant. The expansion valve 23 has a variably controllable opening degree, and is an electronic expansion valve or the like. The expansion valve 23 has its one end connected to the condenser 22 via the refrigerant pipe, and its other end connected to the evaporator 24 via the refrigerant pipe.

The evaporator 24 is configured to evaporate and gasify, through a heat medium such as air, the two-phase gas-liquid refrigerant that flows in from the expansion valve 23. The evaporator 24 has its one end connected to the expansion valve 23 via the refrigerant pipe, and its other end connected to the accumulator 25 via the refrigerant pipe. Note that an air-sending fan (not illustrated) is attached to the evaporator 24. The air-sending fan promotes heat exchange between air supplied from the air-sending fan and the refrigerant flowing through the evaporator 24. Due to the effect of the air-sending fan, the air that has exchanged heat with the refrigerant is supplied, for example, into an air-conditioned space, such as a room or a storage, or the like.

The accumulator 25 is configured to, for example, store an excess refrigerant generated upon a transient change in operation, such as a change in output of the compressor 21, or a conversion of the outside air temperature. The accumulator 25 has its one end connected to the evaporator 24 via the refrigerant pipe, and its other end connected to the suction side of the compressor 21 via the refrigerant pipe.

A state change of the refrigerant circulating in the refrigerant circuit 11 will be described next.

The high-temperature high-pressure gas refrigerant that has been compressed by the compressor 21 flows into the condenser 22, is condensed and liquefied, and turns into a liquid refrigerant. The liquid refrigerant that has flowed out from the condenser 22 flows into the expansion valve 23, is decompressed, and turns into a two-phase gas-liquid refrigerant. Then, the low-pressure, two-phase gas-liquid refrigerant that has flowed out from the expansion valve 23 flows into the evaporator 24, is evaporated and gasified, and turns into a gas refrigerant. The gas refrigerant that has flowed out from the evaporator 24 flows into the accumulator 25, which stores an excess refrigerant generated depending on the operational conditions, load conditions, and the like of the refrigeration cycle device 1. The gas refrigerant that has flowed out from the accumulator 25 without being stored in the accumulator 25 is sucked into the compressor 21, and is compressed again.

The refrigerant at the outlet of the evaporator 24 and the accumulator 25 may be in a low-pressure two-phase state with a high quality, instead of a superheated gas state. The refrigerant circuit 11 is formed in the aforementioned way, and the refrigerant circuit 11 supplies air that has undergone heat exchange into an air-conditioned space, such as a room, or the like.

The configuration of the refrigerant circuit 11 described above is merely an example, and obviously, the configuration of the refrigerant circuit 11 is not limited to the foregoing example.

The composition detection circuit 12, which is one constituent component of the refrigeration cycle device 1, will be described below. Each component of the composition detection circuit 12 will be explained first.

The composition detection circuit 12 is configured to improve the operational reliability during operation by detecting the circulation composition. The composition detection circuit 12 includes the high-and-low-pressure heat exchanger 41, a first temperature sensor 42, a decompression mechanism 43, a pressure sensor 44, a second temperature sensor 45, and the like.

The high-and-low-pressure heat exchanger 41 is configured to exchange heat between a high-pressure zeotropic refrigerant mixture and a low-pressure zeotropic refrigerant mixture. The high-and-low-pressure heat exchanger 41 includes a high-pressure pipe 41*a* in which the high-pressure zeotropic refrigerant mixture discharged from the compressor 21 flows, and a low-pressure pipe 41*b* in which a zeotropic refrigerant mixture decompressed by the decompression mechanism 43 and containing a large amount of high-boiling-point refrigerant flows. In the high-and-low-pressure heat exchanger 41, the high-pressure pipe 41*a* and the low-pressure pipe 41*b* are formed as, for example, a double pipe. The high-pressure pipe 41*a* has its one end that forms the first port 52*a*, and its other end that forms a second port 52*b*. Also, the low-pressure pipe 41*b* has its one end that forms a third port 52*c*, and its other end that forms the fourth port 52*d*.

The first port 52*a*, the second port 52*b*, the third port 52*c*, and the fourth port 52*d* will sometimes be collectively referred to as ports 52 hereinafter.

The decompression mechanism 43 is configured to decompress a refrigerant, and includes, for example, a capillary having a fixed flow resistance. One end of the decompression mechanism 43 is connected to the second port 52*b* of the high-and-low-pressure heat exchanger 41 via the second bypass pipe 51*b*. The other end of the decompression mechanism 43 is connected to the third port 52*c* of the high-and-low-pressure heat exchanger 41 via a third bypass pipe 51*c*. That is, the decompression mechanism 43 decompresses the refrigerant that has flowed in the inlet side thereof, so that a two-phase refrigerant may be flowed out from the outlet side thereof.

The flow resistance at the decompression mechanism 43 described above need not be fixed. For example, the opening degree of the decompression mechanism 43 may be adjusted appropriately so that the refrigerant on the inlet side of the decompression mechanism 43 is a liquid refrigerant and the refrigerant on the outlet side of the decompression mechanism 43 is a two-phase refrigerant. With this configuration, even in the case where a zeotropic refrigerant mixture to be filled in the refrigerant circuit 11 of the refrigeration cycle device 1 is different from a zeotropic refrigerant mixture which has been initially filled in the refrigerant circuit 11, the refrigeration cycle device 1 can be operated by adjusting the opening degree of the decompression mechanism 43.

The first temperature 42 is configured to detect the temperature of a refrigerant on the inlet side of the decompression mechanism 43. The pressure sensor 44 is configured to detect the pressure of a refrigerant on the outlet side of the decompression mechanism 43. The second temperature sensor 45 is configured to detect the temperature of a refrigerant on the outlet side of the decompression mechanism 43. The first temperature sensor 42 and the second temperature sensor 45 are each formed by, for example, a thermistor, and are each configured to convert the temperature detected by the thermistor into an electrical signal. Furthermore, the pressure sensor 44 is configured to, for example, convert the pressure detected by a pressure-sensitive element or the like into an electrical signal. The first temperature sensor 42, the second temperature sensor 45, and the pressure sensor 44 detect refrigerant temperatures and refrigerant pressures at predetermined intervals.

The first temperature sensor 42, the pressure sensor 44, and the second temperature sensor 45 described above illustrate merely examples, and obviously, the first temperature sensor 42, the pressure sensor 44, and the second temperature sensor 45 are not limited to the examples described above.

Note that any one of the first temperature sensor 42 and the second temperature sensor 45 corresponds to temperature detection means in the present invention.

Note also that the pressure sensor 44 corresponds to pressure detection means in the present invention.

Assuming the above-described configuration, the overall connection configuration of the composition detection circuit 12 will be described below. In the composition detection circuit 12, the discharge pipe of the compressor 21 and the high-and-low-pressure heat exchanger 41 are connected via the first bypass pipe 51*a*, as described above. One end of the first bypass pipe 51*a* is directly connected to a pipe branching off from the discharge pipe of the compressor 21 or connected to the branching pipe via a refrigerant pipe connected to the discharge pipe of the compressor 21. That is, one end of the first bypass pipe 51*a* is connected to a portion between the discharge side of the compressor 21 and the condenser 22. Also, the other end of the first bypass pipe 51*a* is connected to the first port 52*a* of the high-and-low-pressure heat exchanger 41.

In the composition detection circuit 12, the high-and-low-pressure heat exchanger 41 and the decompression mechanism 43 are connected via the second bypass pipe 51*b*. The second bypass pipe 51*b* has its one end connected to the second port 52*b* of the high-and-low-pressure heat exchanger 41, and its other end connected to the inlet side of the decompression mechanism 43.

In the composition detection circuit 12, the decompression mechanism 43 and the high-and-low-pressure heat exchanger 41 are connected via the third bypass pipe 51*c*. The third bypass pipe 51*c* has its one end connected to the outlet side of the decompression mechanism 43, and its other end connected to the third port 52*c* of the high-and-low-pressure heat exchanger 41.

In the composition detection circuit 12, the high-and-low-pressure heat exchanger 41 and the suction pipe of the compressor 21 are connected via the fourth bypass pipe 51*d*. The fourth bypass pipe 51*d* has its one end connected to the fourth port 52*d* of the high-and-low-pressure heat exchanger 41, and its other end directly connected to a pipe branching off from the suction pipe of the compressor 21 or connected to the branching pipe via a refrigerant pipe connected to the suction pipe of the compressor 21. That is, the other end of the fourth bypass pipe 51*d* is connected to a portion between the suction pipe of the compressor 21 and the accumulator 25.

The first bypass pipe 51*a*, the second bypass pipe 51*b*, the third bypass pipe 51*c*, and the fourth bypass pipe 51*d* will sometimes be collectively referred to as bypass pipes 51 hereinafter.

The bypass pipes 51 correspond to a bypass pipe in the present invention.

A state change of the refrigerant circulating in the composition detection circuit 12 will be described below. The composition detection circuit 12 is configured such that a refrigerant is split on the discharge side of the compressor 21, and flows through the high-and-low-pressure heat exchanger 41, expands by decompression in the decompression mechanism 43, passes through the high-and-low-pressure heat exchanger 41 again, and merges on the suction side of the compressor 21.

More specifically, first, in the high-and-low-pressure heat exchanger 41, a high-temperature gas refrigerant from the compressor 21 is cooled by heat exchange, and turns into a subcooled liquid. Then, in the decompression mechanism 43, the subcooled liquid is decompressed, and turns into a two-phase refrigerant. Lastly, in the high-and-low-pressure heat exchanger 41, the two-phase refrigerant is superheated, and turns into a gas refrigerant.

That is, the specifications of the high-and-low-pressure heat exchanger 41 and the decompression mechanism 43 are defined in such a manner that a refrigerant on the inlet side of the decompression mechanism 43 is a subcooled liquid and a refrigerant on the outlet side of the decompression mechanism 43 is a two-phase refrigerant.

Therefore, the first temperature sensor 42 is configured to detect the temperature of a refrigerant after passing through the high-and-low-pressure heat exchanger 41 and before flowing into the decompression mechanism 43, the pressure sensor 44 is configured to detect the pressure of a two-phase refrigerant, and the second temperature sensor 45 is configured to detect the temperature of a two-phase refrigerant.

The composition detection circuit 12 is formed in the aforementioned way. Furthermore, as described later, based on a detection result obtained by the composition detection circuit 12, the controller 13 calculates the circulation composition of a refrigerant, and based on the calculation result, the composition detection circuit 12 corrects an output value of the second temperature sensor 45 and an output value of the pressure sensor 44.

The configuration of the composition detecting circuit 12 described above is merely an example, and the configuration of the composition detection circuit 12 is not limited to the foregoing example.

The controller 13, which is a component of the refrigeration cycle device 1, will be explained below. The controller 13 is configured to control the overall system of the refrigeration cycle device 1, and includes a detection control unit 61 and a correction control unit 62.

More specifically, the controller 13 controls the overall operations of the expansion valve 23, the rotation speed of the compressor 21, the rotation speed of the air-sending fan attached to each of the condenser 22 and the evaporator 24, and the like. Furthermore, based on a detection result obtained by the detection control unit 61, the controller 13 controls the operation of the expansion valve 23, the rotation speed of the compressor 21, the rotation speed of the air-sending fan attached to each of the condenser 22 and the evaporator 24, and the like.

Moreover, although details will be described later, the controller 13 corrects an output value of the second temperature sensor 45 and an output value of the pressure sensor 44 by causing the correction control unit 62 to issue a control instruction to the composition detection circuit 12 or by directly controlling the composition detection circuit 12, based on a detection result obtained by the detection control unit 61.

The detection control unit 61 calculates a circulation composition based on detection results obtained by the first temperature sensor 42, the second temperature sensor 45, and the pressure sensor 44, and function expressions represented by equations (4) and (5) (to be described later).

The detection control unit 61 stores equations (4) and (5) (to be described later). For example, the detection control unit 61 stores equations (4) and (5), as expressions which are formulated so that a circulation composition is output as a result, using a polynomial with arguments ($T_1$, $T_2$, P), where $T_1$ is the value detected by the first temperature sensor 42, $T_2$ is the value detected by the second temperature sensor 45, and P is the value detected by the pressure sensor 44. More specifically, the formulated expressions are stored as programs described by an algorithm which can be interpreted and executed by an electronic calculator. In this case, given arguments ($T_1$, $T_2$, P), a circulation composition is calculated by calling the formulated programs. With this configuration, data to be always stored can be reduced.

Figure 5:
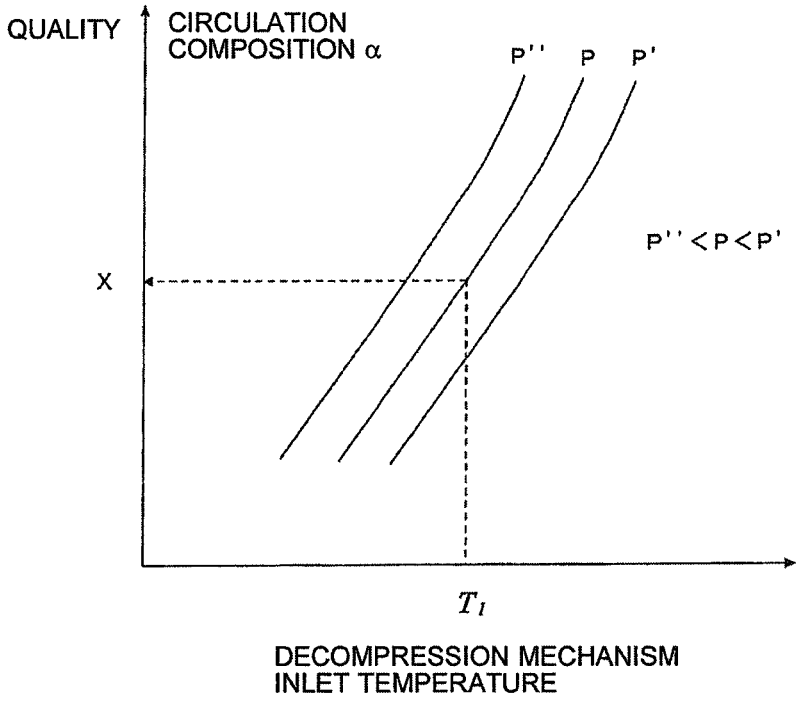
FIG. 5 is an exemplary chart which represents the correlation among the temperature, quality, and pressure of a zeotropic refrigerant mixture with a predetermined circulation composition in Embodiment 1 of the present invention.
Figure 6:
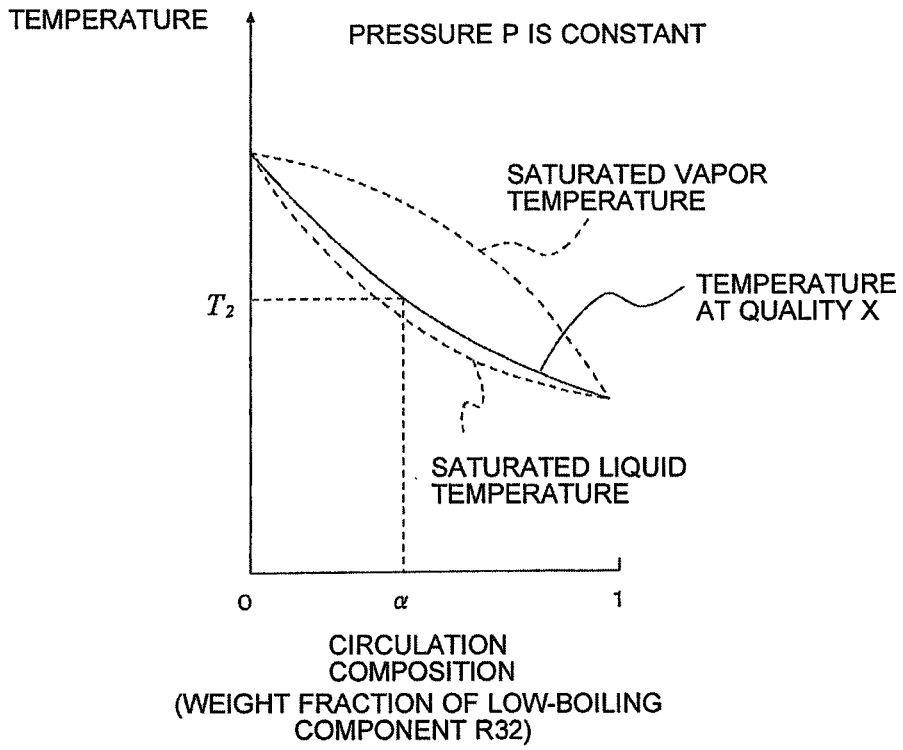
FIG. 6 is an exemplary chart which represents the correlation among the circulation composition, temperature, and quality of a zeotropic refrigerant mixture at a predetermined pressure in Embodiment 1 of the present invention.
Figure 7:
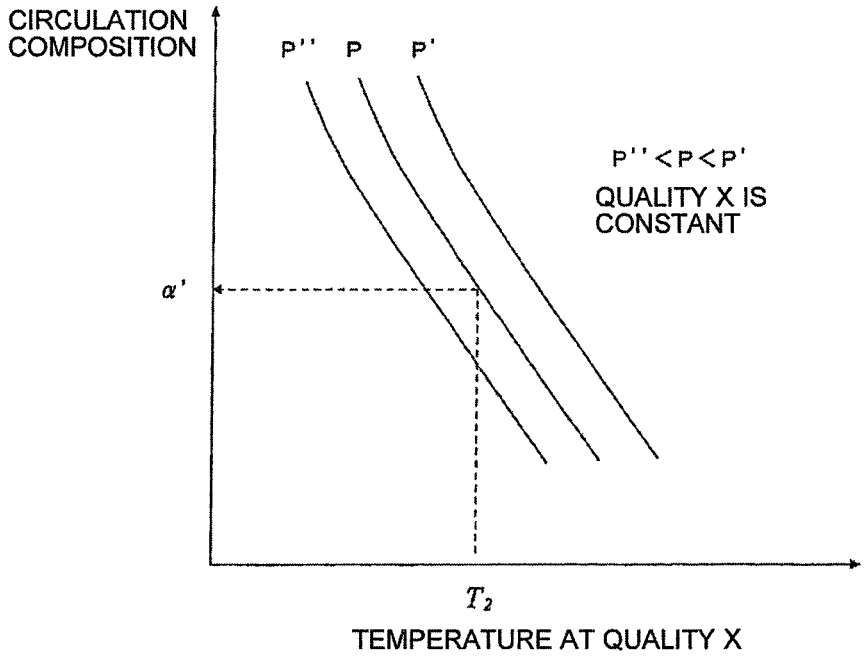
FIG. 7 is an exemplary chart which represents the correlation among the temperature, circulation composition, and pressure of a zeotropic refrigerant mixture at a predetermined quality in Embodiment 1 of the present invention.

Alternatively, the detection control unit 61 may be configured to store equations (4) and (5) (to be described later) in the form of, for example, a data table. More specifically, equations (4) and (5) (to be described later) are represented by correlations illustrated in FIGS. 5, 6 and 7 (to be described later). Therefore, the correlations illustrated in FIGS. 5, 6 and 7 are generated as discrete data in matrix form. Given arguments ($T_1$, $T_2$, P), a circulation composition is obtained by performing interpolation processing for data in matrix form. Interpolation processing need only be performed by an arbitrary interpolation method typified by, for example, linear interpolation. In this case, it is only necessary to hold the data table. Therefore, the data table may be stored in advance in a hard disk drive or the like. Alternatively, the data table may be stored in a semiconductor memory or the like and inserted in a storage unit (not illustrated).

This obviates the need to always use a formulated expression to calculate a circulation composition. Therefore, the calculation time can be reduced by storing equations (4) and (5) (to be described later) in a data table, and a circulation composition can therefore be obtained at high speed. Since a circulation composition can be obtained at high speed, an output value of the second temperature sensor 45 and an output value of the pressure sensor 44 can be corrected earlier, thereby stabilizing control of the refrigeration cycle device 1.

Furthermore, the detection control unit 61 is configured to detect the composition of a low-boiling-point refrigerant. That is, equations (4) and (5) (to be described later) and the data table relate to the refrigerant composition of a low-boiling-point refrigerant. Therefore, in the case where the value of the refrigerant composition of a low-boiling-point refrigerant is represented by a and the refrigerant composition is represented by a weight fraction using not numerical values of 1 to 100 but numerical values of 0 to 1, the refrigerant composition of a high-boiling-point refrigerant can be calculated by $1-\alpha$. Furthermore, in the case where the refrigerant composition is represented by a weight fraction, when the value of the refrigerant composition of the low-boiling-point refrigerant is represented by $\alpha$, the refrigerant composition of the high-boiling-point refrigerant can be calculated by $100-\alpha$.

To put it simply, the method of expressing a refrigerant composition is not particularly limited as long as the ratio of each refrigerant to the entire refrigerant mixture can be expressed.

Furthermore, the detection control unit 61 is set to be able to communicate with the first temperature sensor 42, the pressure sensor 44, and the second temperature sensor 45. When the detection control unit 61 is implemented by, for example, hardware, the detection control unit 61 is capable of data communication with the first temperature sensor 42, the pressure sensor 44, and the second temperature sensor 45 by wired or wireless connection. Similarly, when the detection control unit 61 is implemented by, for example, software, the detection control unit 61 is capable of data communication with the first temperature sensor 42, the pressure sensor 44, and the second temperature sensor 45 through a predetermined protocol conversion.

Note that communication means between the detection control unit 61 and the first temperature sensor 42, the pressure sensor 44, and the second temperature sensor 45 is not particularly limited.

The correction control unit 62 calculates correction values dP and dT for correcting an output value of the second temperature sensor 45 and an output value of the pressure sensor 44, based on the circulation composition calculated by the detection control unit 61, a reference composition value (to be described later) and equation (6) (to be described later), and corrects the output value of the second temperature sensor 45 and the output value of the pressure sensor 44, based on dP and dT.

The correction control unit 62 stores the reference composition value and equation (3) (to be described later). In this case, as is the case of the detection control unit 61, the correction control unit 62 stores equation (3) as a formulated expression. More specifically, the formulated expression is stored as a program described by an algorithm which can be interpreted and executed by an electronic calculator. In this case, given arguments ($T_1$, $T_2$, P), correction values dP and dT are calculated by calling the formulated program. With this configuration, data to be always stored can be reduced.

Furthermore, the correction control unit 62 may store the reference composition value and equation (3) (to be described later) in the form of, for example, a data table. More specifically, the reference composition value and equation (3) (to be described later) are represented by a fixed correlation. Therefore, the fixed correlation is generated as discrete data in matrix form. Given arguments ($T_1$, $T_2$, P), a reference composition value and dP and dT are obtained by performing interpolation processing for data in matrix form. Interpolation processing need only be performed by an arbitrary interpolation method typified by, for example, linear interpolation. In this case, it is only necessary to hold the data table. Therefore, the data table may be stored in advance in a hard disk drive or the like. Alternatively, the data table may be stored in a semiconductor memory or the like and inserted in a storage unit (not illustrated).

This obviates the need to always use a formulated expression to calculate a circulation composition. Therefore, the calculation time can be reduced by storing the reference composition value and equation (3) (to be described later) in a data table, and the reference composition value and dP and dT can therefore be obtained at high speed. Since a reference composition value and dP and dT can be obtained at high speed, an output value of the second temperature sensor 45 and an output value of the pressure sensor 44 can be corrected earlier, thereby stabilizing control of the refrigeration cycle device 1.

Furthermore, the correction control unit 62 is set to be able to communicate with the first temperature sensor 42, the pressure sensor 44, and the second temperature sensor 45. When the correction control unit 62 is implemented by, for example, hardware, the correction control unit 62 is capable of data communication with the first temperature sensor 42, the pressure sensor 44, and the second temperature sensor 45 by wired or wireless connection. Similarly, when the correction control unit 62 is implemented by, for example, software, the correction control unit 62 is capable of data communication with the first temperature sensor 42, the pressure sensor 44, and the second temperature sensor 45 through a predetermined protocol conversion.

Note that communication means between the correction control unit 62 and the first temperature sensor 42, the pressure sensor 44, and the second temperature sensor 45 is not particularly limited.

The controller 13 is formed in the aforementioned way. The controller 13 calculates a refrigerant composition, based on a detection result obtained by the composition detection circuit 12 described above, corrects an output value of the pressure sensor 44 and an output value of the second temperature sensor 45, based on the refrigerant composition obtained by the calculation, controls the rotation speed of the compressor 21, based on results of detection obtained in accordance with the corrected output value of the pressure sensor 44 and the corrected output value of the second temperature sensor 45, and appropriately controls the overall operations of various components or the like which form the refrigerant circuit 11 and the composition detection circuit 12.

The configuration of the controller 13 described above is merely an example, and obviously, the configuration of the controller 13 is not limited to the foregoing example.

In addition, it does not matter whether each function of the controller 13 is implemented by hardware or software. That is, the block diagram illustrating the controller 13 may be construed as either a block diagram of hardware or a functional block diagram of software.

In the case where each function of the controller 13 is implemented by hardware, the detection control unit 61 and the correction control unit 62 are implemented by, for example, microprocessor units.

Each function of the controller 13 may be implemented by hardware different from a microprocessor unit. For example, each function of the controller 13 may be implemented by a mounting a hard wired logic circuit, such as a logic circuit. With this configuration, each function of the controller 13 can be processed at high speed.

Alternatively, in the case where each function of the controller 13 is implemented by software, the detection control unit 61 and the correction control unit 62 may be stored in, for example, a semiconductor memory, such as an SD memory card, or a hard disk drive as program modules. In this case, processing is executed by a Read Only Memory (ROM), a Random Access Memory (RAM), a Central Processing Unit (CPU), or the like (not illustrated). With this configuration, each function of the controller 13 can be updated appropriately. For example, the contents of equations (4) and (5), a data table, and the like can be updated appropriately, and can be stored in advance. That is, the detection control unit 61 and the correction control unit 62 can be updated appropriately and can be stored in advance.

Or again, each function of the controller 13 may be implemented by firmware. With this configuration, each function of the controller 13 can be updated appropriately, and processing can be speeded up more than in the case where this function is implemented as a program module. For example, the contents of equations (4) and (5), a data table, and the like can be updated appropriately, and can be stored in advance. That is, the detection control unit 61 and the correction control unit 62 can be updated appropriately, and can be stored in advance.

Three exemplary conditions under which the refrigerant composition changes will be described below. A change in refrigerant composition means a change in the refrigerant composition which circulates through the refrigerating cycle with respect to the refrigerant composition filled in the refrigeration cycle.

The first exemplary condition will be described. A refrigerant in the accumulator 25 is separated into a liquid-phase refrigerant that contains a large amount of high-boiling-point refrigerant (for example, HFO1234yf) and a gas-phase refrigerant that contains a large amount of low-boiling-point refrigerant (for example, R32). The liquid-phase refrigerant that contains a large amount of high-boiling-point refrigerant is stored in the accumulator 25. In contrast, the gas-phase refrigerant that contains a large amount of low-boiling-point refrigerant flows out of the accumulator 25.

As described above, the liquid-phase refrigerant that contains a large amount of high-boiling-point refrigerant is present in the accumulator 25. Therefore, the composition of a low-boiling-point refrigerant with respect to the entire refrigerant circulating through the refrigeration cycle increases.

The case where the composition ratio of a low-boiling-point refrigerant to the entire refrigerant circulating through the refrigeration cycle decreases, will now be described. For example, it is assumed that the refrigeration cycle device 1 includes a plurality of indoor units, which are performing a heating operation. In this case, when some of the indoor units stop their heating operation in a short time, a liquid refrigerant often remains within the indoor units. Therefore, the composition of the low-boiling-point refrigerant with respect to the entire refrigerant circulating through the refrigeration cycle reduces by the amount of the remaining liquid refrigerant.

The second exemplary condition will be described. In the case where the refrigerant has leaked from the bottom of the accumulator 25, the liquid-phase refrigerant stored at the bottom of the accumulator 25 leaks. The liquid-phase refrigerant contains a large amount of high-boiling-point refrigerant. Therefore, in this case, the composition of a low-boiling-point refrigerant with respect to the entire refrigerant circulating through the refrigeration cycle increases.

The third exemplary condition will be described lastly. For example, in the case where the refrigerant has leaked in a refrigerant pipe through which a single-phase liquid refrigerant flows, such as the refrigerant pipe that connects the condenser 22 and the expansion valve 23 together, a low-boiling-point refrigerant is more likely to gasify and therefore leaks more. As a result, the composition of a high-boiling-point refrigerant with respect to the entire refrigerant circulating through the refrigeration cycle increases.

Apart from the above-described first to third exemplary conditions, there is a possibility that a liquid refrigerant leaks, depending on the way of refrigerant leakage. If no liquid refrigerant is present in the accumulator 25, there is a possibility that the refrigerant composition remains unchanged.

In any of the cases described above, when the circulating refrigerant composition changes, the enthalpy changes even at the same pressure. Therefore, the capacity of the refrigeration cycle device 1 changes. Consequently, in order for the refrigeration cycle device 1 to exhibit a required capacity, the operation of the refrigeration cycle device 1 needs to be controlled after the circulating refrigerant composition is accurately detected.

Figure 2:
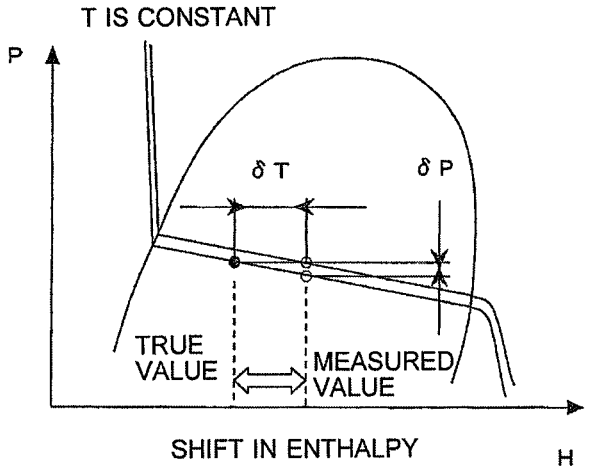
FIG. 2 is a diagram illustrating an example of a Mollier chart for explaining the influence of a sensor error in a conventional refrigeration cycle device.

Details of this mechanism will be explained with reference to FIG. 2. FIG. 2 is a diagram illustrating an example of a Mollier chart for explaining the influence of a sensor error in a conventional device. That is, as illustrated in FIG. 2, in the case of a two-phase refrigerant, errors in measurement of temperature and pressure have a great influence on the Mollier chart, and in the case of subcooling, an error in measurement of temperature does not have great influence on the Mollier chart. Thus, in the refrigeration cycle device 1 according to Embodiment 1, the correction control unit 62 sets an output value of the second temperature sensor 45 that detects the temperature of a two-phase refrigerant and an output value of the pressure sensor 44 that detects the pressure of a two-phase refrigerant as targets to be corrected, and does not set an output value of the first temperature sensor 42 that detects the temperature of a subcooled liquid as a target to be corrected.

In Embodiment 1, the refrigeration cycle device 1 is configured to calculate a circulation composition, detect a circulating refrigerant component with high accuracy, and control the operation using a result of the detection. Furthermore, since the refrigerant composition can be detected with high accuracy, the compressor 21 of the refrigeration cycle device 1 can be suppressed from being damaged. Accordingly, the operational reliability of the refrigeration cycle device 1 can be ensured.

Figure 3:
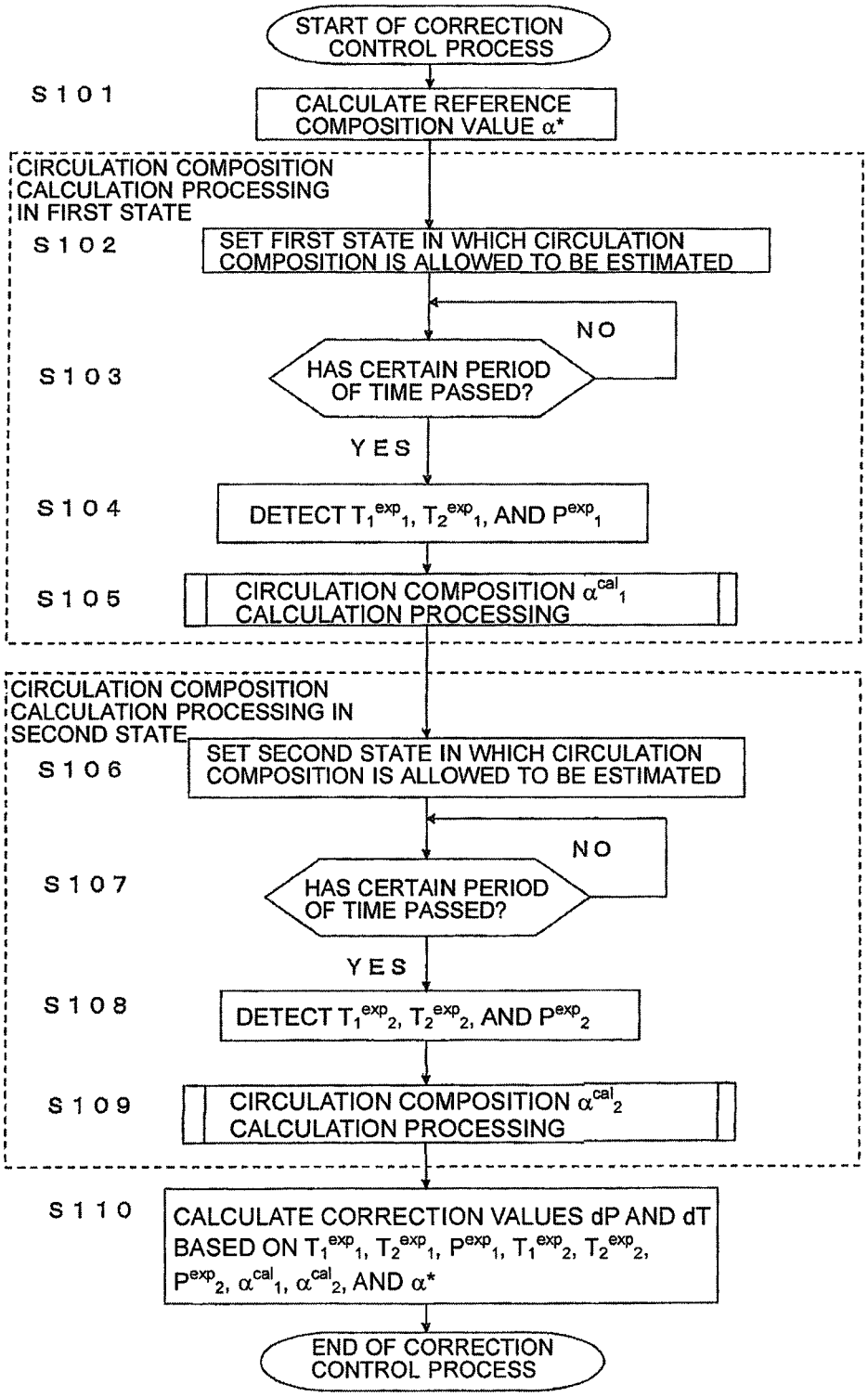
FIG. 3 is a flowchart for explaining a correction control process according to Embodiment 1 of the present invention.

Assuming the configuration described above, a process for correcting output values of individual sensors, which is the principal part of the present invention, will be explained below with reference to FIG. 3. FIG. 3 is a flowchart for explaining a correction control process in Embodiment 1 of the present invention. The correction control process means herein calculating correction values dP and dT for the second temperature sensor 45 and the pressure sensor 44. With the correction control process, an output value of the second temperature sensor 45 and an output value of the pressure sensor 44 can be corrected.

In the correction control process to be explained below, the correction values dP and dT are obtained by obtaining the circulation compositions in two states and solving two simultaneous equations represented by the differences between the two obtained circulation compositions and a reference circulation composition.

(Step S101)

The correction control unit 62 calculates a reference composition value $\alpha^*$.

A reference composition value will be explained first. The reference composition value refers to a reference value used when the correction control unit 62 calibrates the second temperature sensor 45 and the pressure sensor 44.

In determining a reference composition value, attention should be focused on the fact that an attribute of the circulation composition of a refrigerant varies depending on the operation state of the refrigeration cycle device 1. More specifically, since the circulation composition of a refrigerant varies depending on the operation state of the refrigeration cycle device 1, the circulation composition may differ from the filling composition of a refrigerant. When the refrigeration cycle device 1 is in a certain operation state, the refrigerant circulation composition is substantially equal to the refrigerant filling composition. In such a state, no liquid refrigerant remains within the refrigeration cycle. That is, no liquid refrigerant remains within the accumulator 25. In order to obtain such a state, the outlet degree of superheat on the outlet side of the evaporator 24 need only be positive. In this case, the circulation composition of a refrigerant is substantially equal to the reference composition value of the refrigerant. The state at this time is represented by equation (1).

[Math. 1]

$$\text{Reference composition value } \alpha^* = \text{filling composition} + \delta \quad (1)$$

where $\delta$ represents a correction value for obtaining a reference composition value based on a filling composition and takes a positive value as small as about 1 (wt %). $\delta$ can be obtained by calculation based on the specifications of the refrigeration cycle device 1 in advance and is a so-called offset amount which defines the range of tolerance of filling composition. In the condenser 22 and the evaporator 24, although a refrigerant two-phase region exists, since liquid flow rate is lower than the gas flow rate in the refrigerant two-phase region, a gas refrigerant and a liquid refrigerant produce no convection current in the refrigeration cycle. Therefore, the circulation composition of a refrigerant becomes substantially equal to the filling composition of the refrigerant, and the circulation composition of the refrigerant becomes substantially equal to the reference composition value of the refrigerant.

Although a case where $\delta$ is set to 1 (wt %) has been explained above, $\delta$ is not limited to this. $\delta$ may vary depending on the specifications and use environment of the refrigeration cycle device 1.

The reference composition value $\alpha^*$ corresponds to a reference circulation composition value in the present invention.

(Step S102)

The controller 13 sets the operation state of the refrigeration cycle to a first state in which the circulation composition is allowed to be estimated.

Specifically, in the first state in which the circulation composition is allowed to be estimated, no liquid refrigerant remains within the accumulator 25. In order to obtain this state, the outlet degree of superheat on the outlet side of the evaporator 24 needs to be positive.

More specifically, the controller 13 controls the opening degree of the expansion valve 23, the rotation speed of the compressor 21, the rotation speed of the air-sending fan attached to each of the condenser 22 and the evaporator 24, and the like. Accordingly, the controller 13 sets the first state in which the circulation composition is allowed to be estimated.

(Step S103)

The correction control unit 62 determines whether a predetermined period of time has passed. If the predetermined period of time has passed, the correction control unit 62 proceeds to step S104. In contrast, if the predetermined period of time has not passed, the correction control unit 62 returns to step S103.

As described above, by setting the first state in which the circulation composition is allowed to be estimated and then maintaining a standby state for the predetermined period of time, processing which reflects the set state can be performed in subsequent processing. Thus, the predetermined period of time can be set arbitrarily. For example, the predetermined period of time need not necessarily be set long, as long as the environment allows a faster shift to the set state. In contrast, if the environment does not allow a faster shift to the set state, the predetermined period of time needs to be set long. In addition, apart from this, in the case where correction is always performed at predetermined intervals, a predetermined period of time may be secured as a fixed value.

(Step S104)

The correction control unit 62 detects $T_1^{exp}{}_1$, $T_2^{exp}{}_1$, and $P^{exp}{}_1$, where $T_1^{exp}{}_1$ is the refrigerant temperature detected by the first temperature sensor 42 in the first state in which the circulation composition is allowed to be estimated; $T_2^{exp}{}_1$ is the refrigerant temperature detected by the second temperature sensor 45 in the first state in which the circulation composition is allowed to be estimated; and $P^{exp}{}_1$ is the refrigerant pressure detected by the pressure sensor 44 in the first state in which the circulation composition is allowed to be estimated.

The correction control unit 62 detects $T_1^{exp}{}_1$, $T_2^{exp}{}_1$, and $P^{exp}{}_1$, and then stores the detection results in a storage unit (not illustrated).

(Step S105)

The correction control unit 62 causes the detection control unit 61 to perform circulation composition $\alpha^{cal}{}_1$ calculation processing, based on $T_1^{exp}{}_1$, $T_2^{exp}{}_1$, and $P^{exp}{}_1$ detected in step S104, to calculate a circulation composition $\alpha^{cal}{}_1$. The details of the circulation composition $\alpha^{cal}{}_1$ calculation processing will be described later with reference to a flowchart of FIG. 4.

As described above, with the processing of steps S102 to S105, the circulation composition calculation processing in the first state is performed to calculate the circulation composition $\alpha^{cal}{}_1$ The circulation composition $\alpha^{cal}{}_1$ corresponds to a circulation composition value in the present invention.

(Step S106)

The controller 13 sets the operation state of the refrigeration cycle to a second state in which the circulation composition is allowed to be estimated.

Specifically, in the second state in which the circulation composition is allowed to be estimated, no liquid refrigerant remains within the accumulator 25. In order to obtain this state, the outlet degree of superheat on the outlet side of the evaporator 24 need only be positive.

More specifically, the controller 13 controls the opening degree of the expansion valve 23, the rotation speed of the compressor 21, the rotation speed of the air-sending fan attached to each of the condenser 22 and the evaporator 24, and the like. Accordingly, the controller 13 sets the second state in which the circulation composition is allowed to be estimated.

(Step S107)

The correction control unit 62 determines whether a predetermined period of time has passed. If the predetermined period of time has passed, the correction control unit 62 proceeds to step S108. In contrast, if the predetermined period of time has not passed, the correction control unit 62 returns to step S107.

As described above, by setting the second state in which the circulation composition is allowed to be estimated and then maintaining a standby state for the predetermined period of time, processing which reflects the set state can be performed in subsequent processing. Thus, the predetermined period of time can be set arbitrarily. For example, the predetermined period of time need not necessarily be set long, as long as the environment allows a faster shift to the set state. In contrast, if the environment does not allow a faster shift to the set state, the predetermined period of time needs to be set long. In addition, apart from this, in the case where correction is always performed at predetermined intervals, a predetermined period of time may be secured as a fixed value.

(Step S108)

The correction control unit 62 detects $T_1^{exp}{}_2$, $T_2^{exp}{}_2$, and $P^{exp}{}_2$, where $T_1^{exp}{}_2$ is the refrigerant temperature detected by the first temperature sensor 42 in the second state in which the circulation composition is allowed to be estimated; $T_2^{exp}{}_2$ is the refrigerant temperature detected by the second temperature sensor 45 in the second state in which the circulation composition is allowed to be estimated; and $P^{exp}{}_2$ is the refrigerant pressure detected by the pressure sensor 44 in the second state in which the circulation composition is allowed to be estimated.

The correction control unit 62 detects $T_1^{exp}{}_2$, $T_2^{exp}{}_2$, and $P^{exp}{}_2$, and then stores the detection results in a storage unit (not illustrated).

Note that $T_1^{exp}{}_1$, $T_2^{exp}{}_1$, and $P^{exp}{}_1$ detected in step S104 and $T_1^{exp}{}_2$, $T_2^{exp}{}_2$, and $P^{exp}{}_2$ detected in step S108 need to have at least a relation expressed by expression (2). That is, the first state in which the circulation composition is allowed to be estimated and the second state in which the circulation composition is allowed to be estimated need to be different from each other.

[Math. 2]

$$P^{exp}{}_1 \neq P^{exp}{}_2 \text{ or } T_2^{exp}{}_1 \neq T_2^{exp}{}_2 \tag{2}$$

(Step S109)

The correction control unit 62 causes the detection control unit 61 to perform circulation composition $\alpha^{cal}{}_2$ calculation processing, based on $T_1^{exp}{}_2$, $T_2^{exp}{}_2$, and $P^{exp}{}_2$ detected in step S108, to calculate a circulation composition $\alpha^{cal}{}_2$. The details of the circulation composition $\alpha^{cal}{}_2$ calculation processing will be described later with reference to a flowchart of FIG. 8.

As described above, with the processing of steps S106 to S109, the circulation composition calculation processing in the second state is performed to calculate the circulation composition $\alpha^{cal}{}_2$.

The circulation composition $\alpha^{cal}{}_2$ corresponds to a circulation composition value in the present invention.

(Step S110)

The correction control unit 62 obtains the correction value dT of the second temperature sensor 45 and the correction value dP of the pressure sensor 44, based on a relational expression represented by equation (3), and ends the correction control process.

[Math. 3]

$$\begin{pmatrix} dP \\ dT \end{pmatrix} = \begin{pmatrix} \frac{\partial}{\partial P} f(P^{exp_1}, T_1^{exp_1}, T_2^{exp_1}) & \frac{\partial}{\partial T_2} f(P^{exp_1}, T_1^{exp_1}, T_2^{exp_1}) \\ \frac{\partial}{\partial P} f(P^{exp_2}, T_1^{exp_2}, T_2^{exp_2}) & \frac{\partial}{\partial T_2} f(P^{exp_2}, T_1^{exp_2}, T_2^{exp_2}) \end{pmatrix}^{-1} \begin{pmatrix} \alpha^* - \alpha^{cal_1} \\ \alpha^* - \alpha^{cal_2} \end{pmatrix} \tag{3}$$

The processing of steps S101 to S104, the processing of steps S105 to S108, and the processing of step S109 may be performed serially or parallelly. That is, the processing up to step S109 may be performed serially or parallelly.

For calculation of the correction values dP and dT in step S110, not all necessary parameters have to be predetermined. In this case, a predetermined default value can be used as data. With such data, even if any of values of the first temperature sensor 42, the pressure sensor 44, and the second temperature sensor 45 cannot be detected due to failure or the like, the correction values dP and dT can be calculated.

Figure 4:
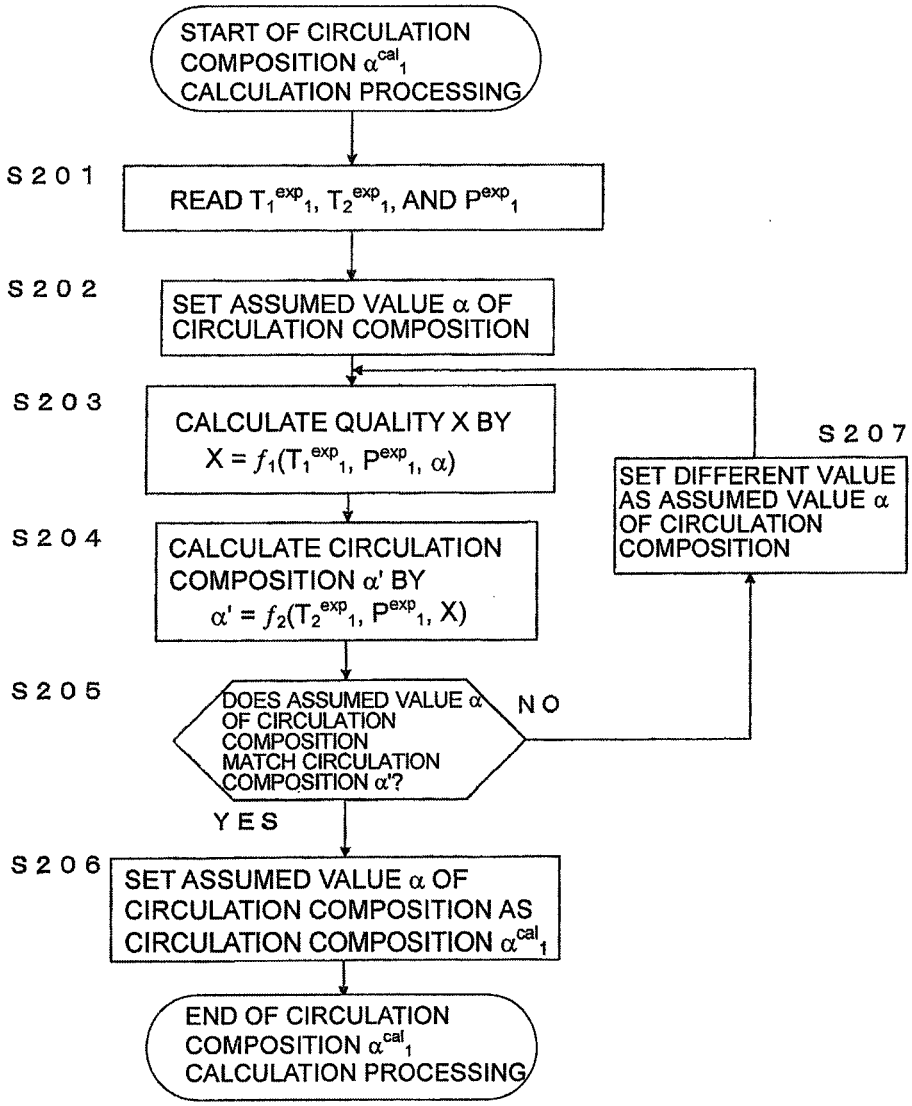
FIG. 4 is a flowchart for explaining the details of circulation composition $\alpha^{cal}{}_1$ calculation processing in Embodiment 1 of the present invention.

FIG. 4 is a flowchart for explaining the details of the circulation composition $\alpha^{cal}{}_1$ calculation processing in Embodiment 1 of the present invention.

(Step S201)

The detection control unit 61 reads $T_1^{exp}{}_1$, $T_2^{exp}{}_1$, and $P^{exp}{}_1$ stored in the storage unit.

(Step S202)

The detection control unit 61 sets an assumed value α of the circulation composition within the refrigeration cycle. Note that the detection control unit 61 sets the assumed value α based on, for example, the latest circulation composition calculated by the detection control unit 61. Accordingly, the number of loops necessary for convergence in steps S 202 to S205 can be reduced, thereby stabilizing the controllability of the refrigeration cycle device 1. Furthermore, if the latest calculation of the circulation composition is unavailable, dummy data can be stored in advance in the storage.

Specifically, the assumed value α of the circulation composition has, as a lower limit, the filling composition and, as an upper limit, the refrigerant composition obtained by adding 5 (wt %) to the filling composition.

(Step S203)

The detection control unit 61 calculates a quality X of the refrigerant on the outlet side of the decompression mechanism 43, based on the assumed value α of the circulation composition, the refrigerant temperature $T_1^{exp}{}_1$ and the refrigerant pressure $P^{exp}{}_1$, and stores the calculation result in a storage unit (not illustrated).

Specifically, since the refrigerant passing through the decompression mechanism 43 expands isentropically, the temperature $T_1^{exp}{}_1$ on the inlet side of the decompression mechanism 43, the pressure $P^{exp}{}_1$ on the outlet side of the decompression mechanism 43, and the quality X have the correlation illustrated in FIG. 5 (to be described later).

FIG. 5 is an exemplary chart illustrating the correlation among the temperature, quality, and pressure of a zeotropic refrigerant mixture with a predetermined circulation composition in Embodiment 1 of the present invention.

As illustrated in FIG. 5, regarding the pressure on the outlet side of the decompression mechanism 43 with the predetermined circulation composition, in the case where the horizontal axis represents the inlet temperature of the decompression mechanism 43 and the vertical axis represents the quality, when the circulation composition, the inlet temperature of the decompression mechanism 43, and the pressure on the outlet side of the decompression mechanism 43 at this time are determined, the quality is obtained. In the example illustrated in FIG. 5, three pressures are applied on the outlet side of the decompression mechanism 43, and, for example, a relation P"<P<P' is obtained.

Note that the relationship illustrated in FIG. 5 is expressed by equation (4).

[Math. 4]

$$X=F_1(T_1,P,\alpha) \tag{4}$$

As described above, by storing the relationship expressed by equation (4) in the detection control unit 61, the quality X of the refrigerant at the outlet of the decompression mechanism 43 can be obtained based on the temperature $T_1^{exp}{}_1$, the pressure $P^{exp}{}_1$, and the circulation composition assumed value α, using the correlation expressed by equation (4).

(Step S204)

The detection control unit 61 calculates a circulation composition α', based on the outlet temperature $T_2^{exp}{}_1$ and the pressure $P^{exp}{}_1$ of the decompression mechanism 43, and the quality X stored in the storage unit.

Specifically, at a predetermined pressure, the temperature of a zeotropic refrigerant mixture in a two-phase gas-liquid state with the quality X has a correlation illustrated in FIG. 6, which will be explained below, with the circulation composition within the refrigeration cycle, that is, the circulation composition flowing in the composition detection circuit 12.

FIG. 6 is an exemplary chart illustrating the correlation among the circulation composition, temperature, and quality of a zeotropic refrigerant mixture at a predetermined pressure in Embodiment 1 of the present invention.

As illustrated in FIG. 6, regarding the circulation composition of the zeotropic refrigerant mixture at the predetermined pressure, in the case where the horizontal axis represents the circulation composition and the vertical axis represents the outlet temperature $T_2^{exp}{}_1$ on the outlet side of the decompression mechanism 43, when the pressure, the outlet temperature $T_2^{exp}{}_1$ on the outlet side of the decompression mechanism 43, and the quality at the outlet temperature $T_2^{exp}{}_1$ are determined, the circulation composition at this time is obtained. In the example illustrated in FIG. 6, the circulation composition is equivalent to the weight fraction of the low-boiling-point component R32, and a characteristic curve of the temperature at the quality X is present to vary within the range surrounded by characteristic curves of the saturated vapor temperature and saturated liquid temperature.

As illustrated in FIG. 6, although the weight fraction of the low-boiling-point component R32 is represented by numerical values of 0 to 1, the weight fraction is not limited to this as long as it represents the ratio of the low-boiling-point component R32 to the entire refrigerant mixture.

FIG. 7 illustrates a relationship for obtaining the circulation composition α' based on the temperature $T_2^{exp}{}_1$, the pressure, and the quality X on the outlet side of the decompression mechanism 43, in accordance with the correlation illustrated in FIG. 6.

FIG. 7 is an exemplary chart illustrating the correlation among the temperature, the circulation composition, and the pressure of a zeotropic refrigerant mixture at a predetermined quality in Embodiment 1 of the present invention.

As illustrated in FIG. 7, regarding the circulation composition at the predetermined quality, in the case where the horizontal axis represents the temperature at the quality X and the vertical axis represents the circulation composition, when the temperature $T_2^{exp}{}_1$, the pressure, and the quality X on the outlet side of the decompression mechanism 43 are determined, the circulation composition at this time is obtained. In the example illustrated in FIG. 7, three pressures are applied on the outlet side of the decompression mechanism 43 at a constant quality X, and, for example, a relation P"<P<P' is obtained.

Note that the relationship illustrated in FIG. 7 is expressed by equation (5).

[Math. 5]

$$\alpha'=F_2(T_2,P,X) \tag{5}$$

As described above, by storing the relationship expressed by equation (5) in the detection control unit 61, the circulation composition α' can be calculated based on the outlet temperature $T_2^{exp}{}_1$, the pressure $P^{exp}{}_1$, and the quality X, using the correlation expressed by equation (5).

(Step S205)

The detection control unit 61 determines whether the circulation composition α' matches the initially set circulation composition assumed value α.

If the circulation composition α' matches the initially set circulation composition assumed value α, the detection control unit 61 proceeds to step S206. In contrast, if the circulation composition α' does not match the initially set circulation composition assumed value α, the detection control unit 61 proceeds to step S207.

(Step S206)

The detection control unit 61 sets the circulation composition assumed value α as the circulation composition $\alpha^{cal}{}_1$, and the processing ends.

(Step S207)

The detection control unit 61 sets a different value as the circulation composition assumed value α, and returns to step S203.

Note that even in the case where a different value is set as the circulation composition assumed value, if the circulation composition α' does not match the reset circulation composition assumed value α, for example, the average of the circulation composition α' and the reset circulation composition assumed value α is set as a new circulation composition assumed value α.

In this case, a method for calculating the average value is not particularly limited. Calculation can be performed using various methods, such as the arithmetic mean, geometric mean, logarithmic mean, and moving average methods. Furthermore, in order to find a convergence value, existing various search algorithms may be used. Calculation can be performed using various methods, such as the list search, tree search, and graph search methods. With such a calculation method, even if a convergence value is hard to find in processing for matching the circulation composition α' with the reset circulation composition assumed value α, it can be found as quickly as possible using a search problem for a solution.

As described above, the detection control unit 61 of the controller 13 calculates the quality of a refrigerant on the outlet side of the decompression mechanism 43 to calculate the circulation composition. Thus, even if the operation state of the refrigeration cycle has changed, and the amount of heat exchange of the high-and-low-pressure heat exchanger 41 has thus changed, a circulation composition can reliably be detected.

Figure 8:
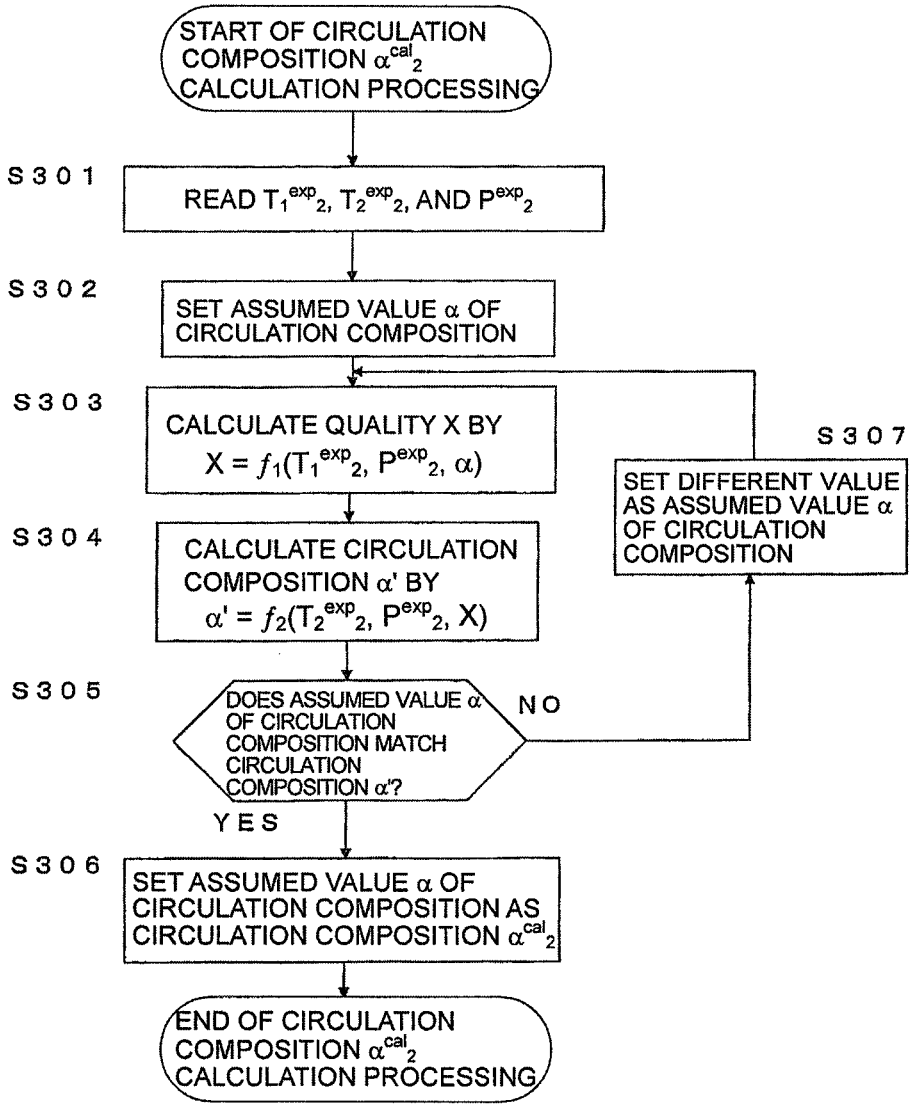
FIG. 8 is a flowchart for explaining the details of circulation composition $\alpha^{cal}{}_2$ calculation processing in Embodiment 1 of the present invention.

FIG. 8 is a flowchart for explaining the details of the circulation composition $\alpha^{cal}{}_2$ calculation processing in Embodiment 1 of the present invention.

(Step S301)

The detection control unit 61 reads $T_1{}^{exp}{}_2$, $T_2{}^{exp}{}_2$, and $P^{exp}{}_2$ stored in the storage unit.

(Step S302)

The detection control unit 61 sets the circulation composition assumed value α in the refrigeration cycle. Note that the detection control unit 61 sets the assumed value α based on, for example, the latest circulation composition calculated by the detection control unit 61. Accordingly, the number of loops necessary for convergence in steps S302 to S305 can be reduced, thereby stabilizing the controllability of the refrigeration cycle device 1. Furthermore, if the latest calculation of the circulation composition is unavailable, dummy data can be stored in advance in the storage.

(Step S303)

The detection control unit 61 calculates the quality X of the refrigerant on the outlet side of the decompression mechanism 43, based on the circulation composition assumed value α, the refrigerant temperature $T_1{}^{exp}{}_2$, and the refrigerant pressure $P^{exp}{}_2$, and stores the calculation result in the storage unit (not illustrated).

Specifically, since the refrigerant passing through the decompression mechanism 43 expands isentropically, the temperature $T_1{}^{exp}{}_2$ on the inlet side of the decompression mechanism 43, the pressure $P^{exp}{}_2$ on the outlet side of the decompression mechanism 43, and the quality X have the correlation illustrated in FIG. 5 described above.

Note that the relationship illustrated in FIG. 5 is expressed by equation (4) described above.

As described above, by storing the relationship expressed by equation (4) in the detection control unit 61, the quality X of the refrigerant at the outlet of the decompression mechanism 43 can be calculated based on the temperature $T_1{}^{exp}{}_2$, the pressure $P^{exp}{}_2$, and the circulation composition assumed value α, using the correlation expressed by equation (4).

(Step S304)

The detection control unit 61 calculates the circulation composition α', based on the outlet temperature $T_2{}^{exp}{}_2$ of the decompression mechanism 43, the pressure $P^{exp}{}_2$, and the quality X stored in the storage unit.

Specifically, at a predetermined pressure, the temperature of a zeotropic refrigerant mixture in a two-phase gas-liquid state with the quality X exhibits the correlation illustrated in FIG. 6 described above, with the circulation composition within the refrigeration cycle, that is, the circulation composition flowing in the composition detection circuit 12.

Note that the relationship illustrated in FIG. 7 is expressed by equation (5) described above.

As described above, by storing the relationship expressed by equation (5) in the detection control unit 61, the circulation composition α' can be calculated based on the temperature $T_2{}^{exp}{}_2$, the pressure $P^{exp}{}_2$, and the quality X, using the correlation expressed by equation (5).

(Step S305)

The detection control unit 61 determines whether the circulation composition α' matches the initially set circulation composition assumed value α.

If the circulation composition α' matches the initially set circulation composition assumed value α, the detection control unit 61 proceeds to step S306. In contrast, if the circulation composition α' does not match the initially set circulation composition assumed value α, the detection control unit 61 proceeds to step S307.

(Step S306)

The detection control unit 61 sets the circulation composition assumed value α as the circulation composition $\alpha^{cal}{}_2$, and the processing ends.

(Step S307)

The detection control unit 61 sets a different value as the circulation composition assumed value α, and returns to step S303.

Note that even in the case where a different value is set as the circulation composition assumed value, if the circulation composition α' does not match the reset circulation composition assumed value α the average of the circulation composition α' and the reset circulation composition assumed value α, for example, is set as a new circulation composition assumed value α.

In this case, a method for calculating the average value is not particularly limited. Calculation can be performed using various methods, such as the arithmetic mean, geometric mean, logarithmic mean, and moving average methods. Furthermore, in order to find a convergence value, existing various search algorithms may be used. Calculation can be performed using various methods, such as the list search, tree search, and graph search methods. With such a calculation method, even if a convergence value is hard to find in processing for matching the circulation composition α' with the reset circulation composition assumed value α, it can be found as quickly as possible using a search problem for a solution.

As described above, the detection control unit 61 of the controller 13 calculates the quality of a refrigerant on the outlet side of the decompression mechanism 43 to calculate the circulation composition. Thus, even if the operation state of the refrigeration cycle has changed, and the amount of heat exchange of the high-and-low-pressure heat exchanger 41 has thus changed, a circulation composition can reliably be detected.

Next, the relationship between equations (4) and (5) is defined.

Equation (4) is substituted into equation (5) to obtain equation (6).

[Math. 6]

$$\alpha' = F_2(T_2, P, F_1(T_1, P, \alpha)) \tag{6}$$

The arguments in the polynomial expressed by equation (6) are described by a function as per equation (7).

[Math. 7]

$$F(P, T_1, T_2, \alpha) = 0 \tag{7}$$

Equation (7) is transformed into an inverse function as per equation (8).

[Math. 8]

$$\alpha=F^{-1}(P,T_1,T_2) \tag{8}$$

When equation (8) is defined as a map that associates a set of the temperature $T_1^{exp}{}_1$, the temperature $T_2^{exp}{}_1$, the temperature $T_1^{exp}{}_2$, the temperature $T_2^{exp}{}_2$, the pressure $P^{exp}{}_1$, and the pressure $P^{exp}{}_2$ with a set of circulation compositions to transform it into equation (9).

[Math. 9]

$$\alpha=f(P,T_1,T_2) \tag{9}$$

Next, derivation of aforementioned equation (3) will be explained below.

In step S104, equation (10) holds from equation (9).

[Math. 10]

$$f(P^{exp}{}_1,T_1^{exp}{}_1,T_2^{exp}{}_1)=\alpha^{cal}{}_1 \tag{10}$$

Further, since the detection control unit 61 outputs a reference composition value after the correction control unit 62 corrects an output value of the second temperature sensor 45 and an output value of the pressure sensor 44, the state at this time is described by equation (11).

[Math. 11]

$$f(P^{exp}{}_1+dP,T_1^{exp}{}_1,T_2^{exp}{}_1+dT)=\alpha^* \tag{11}$$

Equation (11) is approximated as equation (12).

[Math. 12]

$$f(P^{exp1}+dP,T_1^{exp1},T_2^{exp1}+dT)\cong f(P^{exp1},T_1^{exp1},T_2^{exp1})+\frac{\partial}{\partial P}f(P^{exp1},T_1^{exp1},T_2^{exp1})dP+\frac{\partial}{\partial T_2}f(P^{exp1},T_1^{exp1},T_2^{exp1})dT \tag{12}$$

Thus, equation (13) is derived from equations (10) to (12).

[Math. 13]

$$\alpha^*-\alpha^{cal1}\cong\frac{\partial}{\partial P}f(P^{exp1},T_1^{exp1},T_2^{exp1})dP+\frac{\partial}{\partial T_2}f(P^{exp1},T_1^{exp1},T_2^{exp1})dT \tag{13}$$

Next, in step S108, equation (14) is similarly derived.

[Math. 14]

$$\alpha^*-\alpha^{cal2}\cong\frac{\partial}{\partial P}f(P^{exp2},T_1^{exp2},T_2^{exp2})dP+\frac{\partial}{\partial T_2}f(P^{exp2},T_1^{exp2},T_2^{exp2})dT \tag{14}$$

Thus, equation (3) is derived from equations (13) and (14).

Accordingly, in the refrigeration cycle device 1, the correction control unit 62 obtains the correction values dP and dT based on the derived equation (3), and the obtained correction values dP and dT are stored in the storage unit (not illustrated). When the correction values dP and dT are determined, the detection control unit 61 calculates the circulation composition, upon calibrating the values of $T_1$, $T_2$, and P detected by the first temperature sensor 42, the second temperature sensor 45, and the pressure sensor 44, as $T_1$ $T_2$+dT, and P+dP and dT. That is, the output value of the second temperature sensor 45 and the output value of the pressure sensor 44 are corrected as $T_2^{exp}{}_1$+dT and $P^{exp}{}_1$+dP so as to obtain the state of the reference composition value $\alpha^*$ as described by equation (11).

Note that the correction values dP and dT may be either positive or negative.

Accordingly, even if the detection accuracy of each individual sensor, such as the first temperature sensor 42, the second temperature sensor 45, and the pressure sensor 44, is not improved, the circulation composition can be detected accurately.

Specifically, even if the detection accuracy of each individual sensor stays the same, simultaneous equations including the correction values dP and dT assumed are established based on the difference between the specific reference value and the detection result obtained by each of these sensors, as per equations (13) and (14), and are calculated based on equation (3) to obtain the correction values dP and dT. Thus, even if an error is included in the detection result obtained by each individual sensor, it can be concealed.

More specifically, output values of individual sensors are corrected so that a specific reference value matches a circulation composition obtained based on detection results obtained by the individual sensors. That is, the differences between values including measurement errors due to factors associated with the individual sensors or the like and a specific reference value, which serves as a target, are set to the correction values dP and dT. Thus, even if the circulation composition obtained based on the detection results obtained by the individual sensors includes measurement errors due to factors associated with the individual sensors, accurate correction can be performed independently of these errors.

To put it simply, by correcting the output value of the second temperature sensor 45 and the output value of the pressure sensor 44 as $T_2^{exp}{}_1$+dT and $P^{exp}{}_1$+dP, respectively, the output values of the individual sensors are corrected so as to be fall within the range of tolerance of filling composition.

Therefore, a refrigeration cycle device which costs little but nonetheless is capable of detecting the circulation composition within a refrigeration cycle more accurately than conventional refrigeration cycle devices can be provided.

With the configuration described above, even if the detection accuracy of each individual sensor stays the same or even if the same method is adopted to mount them onto the refrigeration cycle device, the refrigeration cycle device 1 is able to improve the detection accuracy of measurement independently of variations among the individual sensors or variations in mounting them onto the refrigeration cycle device 1. Therefore, the accuracy in detection of the composition of a circulating refrigerant may be improved.

Furthermore, when the refrigeration cycle device 1 is stopped, the pressure within the refrigeration cycle is uniform. Thus, the refrigeration cycle device 1 is able to correct the output values of other pressure sensors (not illustrated) to be equal to the corrected output value of the pressure sensor 44 as a reference. Accordingly, the detection accuracy of the other pressure sensors (not illustrated) is also improved. Thus, the refrigeration cycle device 1 attains more stable operation control.

The case where the reference composition value is fixed has been explained above. However, the reference composition value is not limited to this. For example, the reference composition value may be changed according to the temperature of a heat medium which exchanges heat with a refrigerant in the condenser 22 and the evaporator 24. With this configuration, a more accurate value can be used as a reference for correction. Thus, the composition detection accuracy can further be improved.

Furthermore, in Embodiment 1, the refrigeration cycle device 1 is operated in the first state in which the circulation composition is allowed to be estimated and in the second state in which the circulation composition is allowed to be estimated, and an output value of the second temperature sensor 45 and an output value of the pressure sensor 44 are corrected.

However, it is often the case that even the aforementioned correction process cannot sufficiently improve the detection accuracy of the pressure sensor 44 or correction itself is unnecessary. In this case, the refrigeration cycle device 1 may be operated only in the first state in which the circulation composition is allowed to be estimated, and the correction value dP of the pressure sensor 44 may be set to 0. In this case, equation (13) can be rewritten as equation (15).

[Math. 15]

$$dT = \frac{\alpha^* - \alpha^{cal_1}}{\frac{\partial}{\partial T_2} f(P^{exp_1}, T_1^{exp_1}, T_2^{exp_1})} \tag{15}$$

The correction value dT of the second temperature sensor 45 may be obtained in the aforementioned way.

Similarly, it is often the case that correction cannot sufficiently improve the detection accuracy of the second temperature sensor 45 or correction itself is unnecessary. In this case, the refrigeration cycle device 1 may be operated only in the first state in which the circulation composition is allowed to be estimated, and the correction value dT of the second temperature sensor 45 may be set to 0. In this case, equation (13) can be rewritten as equation (16).

[Math. 16]

$$dP = \frac{\alpha^* - \alpha^{cal_1}}{\frac{\partial}{\partial P} f(P^{exp_1}, T_1^{exp_1}, T_2^{exp_1})} \tag{16}$$

The correction value dP of the pressure sensor 44 may be obtained in the aforementioned way.

By omitting unnecessary correction processing as described above, the time required for the entire correction process can be shortened. Furthermore, the total amount of information to be stored in the correction control unit 62 can be reduced. Accordingly, the cost can be reduced.

Furthermore, the timing when the correction control unit 62 is operated is not particularly limited. However, a correction control process may be performed by the correction control unit 62, for example, when the refrigeration cycle device 1 is activated or after the refrigeration cycle device 1 has been in operation for a predetermined period of time or more.

With this configuration, for example, even if the power supplied to the refrigeration cycle device 1 undergoes long-term variations, which are expected to fluctuate the output value of the second temperature sensor 45 or the pressure sensor 44, appropriate correction of the output values of the individual sensors makes it possible to suppress a reduction in composition detection accuracy in the state in which the refrigeration cycle device 1 is in operation.

Furthermore, every time processing is performed by the correction control unit 62, it may be determined whether the difference between the reference composition value and the latest detection result obtained by the detection control unit is equal to or greater than a specific value. On the assumption that the variations in detection accuracy of individual sensors are evaluated in advance, the composition detection accuracy can sometimes be predicted. That is, if the difference between the reference composition value and the latest detection result obtained by the detection control unit is equal to or greater than the specific value, it can be determined that such a difference has been generated due to factors other than the variations. Accordingly, it can be determined that a refrigerant has leaked from the refrigeration cycle device 1. Detecting refrigerant leakage in the above-mentioned way is also effective in terms of protection of global environment.

Although an example in which R32 and HFO1234yf are adopted as a zeotropic refrigerant mixture has been explained in Embodiment 1, the zeotropic refrigerant mixture is not limited to this. The zeotropic refrigerant mixture may contain another low-boiling-point refrigerant and another high-boiling-point refrigerant. Examples of the zeotropic refrigerant mixture include hydrofluoroolefin-based refrigerants having double bond, a refrigerant having low combustibility, and a combustible HC-based refrigerant.

Furthermore, an example in which the zeotropic refrigerant mixture used is a mixture of two refrigerants has been explained in Embodiment 1. However, the zeotropic refrigerant mixture is not limited to this. Azeotropic refrigerant mixture may be formed by mixing, for example, three or more refrigerants. In the case of a mixture of three or more refrigerants, the refrigerant composition (for example, a composition relational expression representing a correlation as explained above) of a refrigerant other than a refrigerant for which the refrigerant composition is to be calculated need only be calculated in advance by experiments, simulations, or the like. With this configuration, as is the case with the refrigeration cycle device 1 according to Embodiment 1, by calculating the refrigerant composition of one refrigerant, the refrigerant composition of another refrigerant can also be calculated.

Although an example in which the single condenser 22, the single expansion valve 23, and the single evaporator 24 are provided has been explained in Embodiment 1, the numbers of condensers 22, expansion valves 23, and evaporators 24 are not limited to one. For example, pluralities of condensers 22, expansion valves 23, and evaporators 24 may be provided together with a plurality of paths in which they are arranged. Furthermore, a medium that exchanges heat with a refrigerant in the condenser 22 or the evaporator 24 is not limited to the air. For example, water, brine, or the like may exchange heat with this refrigerant.

Also, the refrigeration cycle device 1 may be used for any of air-conditioning, refrigeration, hot water supply, and the like.

Moreover, in Embodiment 1, although flow of refrigerant never reverses, a cooling operation (cooling energy supply) and a heating operation (heating energy supply) may be performed by providing a four-way valve and interchanging the relative positions of the condenser 22 and the evaporator 24.

Again, the accumulator 25 on the low-pressure side of the refrigeration cycle handles an excess refrigerant in Embodiment 1. Obviously, however, an excess refrigerant may be handled by a liquid reservoir on the high-pressure side or intermediate position of the refrigeration cycle.

The two-phase state of the refrigerant on the outlet side of the decompression mechanism 43 is detected in Embodiment 1. However, detection of the two-phase state is not limited to this. Detection may be performed at another position in the refrigeration cycle as long as the refrigerant is in the two-phase state.

In addition, in Embodiment 1, in the case where the reference composition value of a refrigerant and the circulation composition value calculated based on the detection result obtained by each individual sensor are the same from the beginning, there is no need to correct output values of these sensors.

In Embodiment 1, steps describing a program recorded on a recording medium or the like (not illustrated) include not only time-series processing to be executed in accordance with the described sequence but also parallel or independent processing to be executed instead of always executing time-series processing.

As described above, according to an Embodiment of the present invention, the refrigeration cycle device 1 that circulates a zeotropic refrigerant mixture through the refrigeration cycle in which the compressor 21, the condenser 22, the expansion valve 23, and the evaporator 24 are connected by a refrigerant pipe, includes the first temperature sensor 42 and the second temperature sensor 45 that detect the temperatures of a refrigerant on the inlet side and the outlet side, respectively, of a portion in which the zeotropic refrigerant mixture discharged from the compressor 21 is in a two-phase gas-liquid state; the pressure sensor 44 that detects the pressure of the refrigerant on the outlet side; the detection control unit 61 that calculates a circulation composition value of the zeotropic refrigerant mixture, based on values of the temperatures of the zeotropic refrigerant mixture detected by the first temperature sensor 42 and the second temperature sensor 45 and a value of the pressure of the zeotropic refrigerant mixture detected by the pressure sensor 44; the correction control unit 62 that corrects at least one of the values of the temperatures of the zeotropic refrigerant mixture and the value of the pressure of the zeotropic refrigerant mixture, based on the circulation composition value calculated by the detection control unit 61; and the controller 13 that drives the compressor 21. The detection control unit 61 calculates a reference composition value, which is a reference circulation composition value, based on the filling composition of the zeotropic refrigerant mixture at the time of filling in the refrigeration cycle, and calculates a circulation composition value of the zeotropic refrigerant mixture, based on states before and after the values of the temperatures of the zeotropic refrigerant mixture and the value of the pressure of the zeotropic refrigerant mixture change during the operation of the refrigeration cycle. The correction control unit 62 calculates at least one of the correction value dT for correcting a detection result obtained by a second temperature sensor that detects the refrigerant temperature on the outlet side and the correction value dP for correcting the detection result obtained by the pressure sensor 44, based on the reference composition value and the circulation composition value of the zeotropic refrigerant mixture. The controller 13 operates the refrigeration cycle by driving the compressor 21, based on a detection result obtained by the detection control unit 61 after correction by the correction control unit 62. Accordingly, the refrigeration cycle device 1 costs little but nonetheless is capable of detecting the circulation composition within the refrigeration cycle more accurately than conventional refrigeration cycle devices, and thus provides a practical configuration that exhibits improved operational reliability during operation.

REFERENCE SIGNS LIST

1: refrigeration cycle device, 11: refrigerant circuit, 12: composition detection circuit, 13: controller, 21: compressor, 22: condenser, 23: expansion valve, 24: evaporator, 25: accumulator, 41: high-and-low-pressure heat exchanger, 41*a*: high-pressure pipe, 41*b*: low-pressure pipe, 42: first temperature sensor, 43: decompression mechanism, 44: pressure sensor, 45: second temperature sensor, 51: bypass pipe, 51*a*: first bypass pipe, 51*b*: second bypass pipe, 51*c*: third bypass pipe, 51*d*: fourth bypass pipe, 52: port, 52*a*: first port, 52*b*: second port, 52*c*: third port, 52*d*: fourth port, 61: detection control unit, 62: correction control unit

The invention claimed is:

1. A refrigeration cycle device that circulates a zeotropic refrigerant mixture through a refrigeration cycle in which a compressor, a condenser, an expansion valve, and an evaporator are connected by a refrigerant pipe, comprising:

a first temperature sensor that detects refrigerant temperature on an inlet side of a portion in which the zeotropic refrigerant mixture discharged from the compressor is in a two-phase gas-liquid state, thereby obtaining a detected temperature value;

a second temperature sensor that detects refrigerant temperature on an outlet side of the portion in which the zeotropic refrigerant mixture discharged from the compressor is in the two-phase gas-liquid state, thereby obtaining a detected temperature value;

a pressure sensor that detects a refrigerant pressure on the outlet side, thereby obtaining a detected pressure value; and a correction control unit configured to replace at least one of output values of the detected temperature value of the zeotropic refrigerant mixture in the two-phase gas-liquid state on the outlet side detected by the second temperature sensor and the detected pressure value of the pressure of the zeotropic refrigerant mixture in the two-phase gas-liquid state detected by the pressure sensor with a corresponding corrected temperature value or pressure value, the corresponding corrected temperature value or pressure value is obtained based on a reference composition value $\alpha^*$ and a circulation composition value $\alpha^{cal}$, the circulation composition value $\alpha^{cal}$ being calculated by the detected temperature values of the zeotropic refrigerant mixture detected by the first and the second temperature sensors and the detected pressure value of the zeotropic refrigerant mixture detected by the pressure sensor.

2. The refrigeration cycle device of claim 1, wherein the zeotropic refrigerant mixture contains two or more components, one of which is R32 serving as a low-boiling-point refrigerant.

3. The refrigeration cycle device of claim 1, wherein the zeotropic refrigerant mixture contains two or more components, one of which is a hydrofluoroolefin-based refrigerant serving as a high-boiling-point refrigerant.

4. The refrigeration cycle device of claim 1, further comprising:

a detection control unit, wherein the detection control unit calculates a circulation composition value $\alpha^{cal}$ of the zeotropic refrigerant mixture, based on the detected temperature values of the zeotropic refrigerant mixture detected by the first and the second temperature sensors and the detected pressure value of the pressure of the zeotropic refrigerant mixture detected by the pressure sensor, the correction control unit calculates the reference composition value $\alpha^*$, which is a reference circulation composition value, based on a filling composition of the zeotropic refrigerant mixture at a time of filling in the refrigeration cycle, and calculates at least one of a temperature correction value for correcting a detection result obtained by the second temperature sensor for detecting the refrigerant temperature on the outlet side and a pressure correction value for correcting a detection result obtained by the pressure sensor, based on the reference composition value $\alpha^*$ and the circulation composition value $\alpha^{cal}$ of the zeotropic refrigerant mixture, and the refrigeration cycle device is controlled in operation, based on the value corrected by the correction control unit.

5. The refrigeration cycle device of claim 4, wherein the correction control unit corrects the detection result obtained by the pressure sensor and the detection results obtained by the temperature sensors, and the correction control unit operates in one of a first and a second state, which are different from each other:

in the first state a first refrigerant circulation composition value $\alpha^{cal}{}_1$ obtained by the detection control unit by operating the refrigeration cycle is allowed to be estimated and match the reference composition value $\alpha^*$, and in the second state a second refrigerant circulation composition value $\alpha^{cal}{}_2$ obtained by the detection control unit by operating the refrigeration cycle is allowed to be estimated and match the reference composition value $\alpha^*$.

6. The refrigeration cycle device of claim 4, wherein the correction control unit corrects the detection result obtained by the pressure sensor where the circulation composition value $\alpha^{cal}$ obtained by operating the refrigeration cycle in a state in which the circulation composition value $\alpha^{cal}$ of the zeotropic refrigerant mixture is allowed to be estimated matches the reference composition value $\alpha^*$.

7. The refrigeration cycle device of claim 4, wherein the correction control unit corrects the detection result obtained by the second temperature sensor where the circulation composition value $\alpha^{cal}$ obtained by operating the refrigeration cycle in a state in which the circulation composition value $\alpha^{cal}$ of the zeotropic refrigerant mixture is allowed to be estimated matches the reference composition value $\alpha^*$.

8. The refrigeration cycle device of claim 4, further comprising:

a bypass pipe that branches off from a discharge side of the compressor and is connected to a suction side of the compressor;

a decompression mechanism that is provided at the bypass pipe and decompresses the zeotropic refrigerant mixture discharged from the compressor; and a high-and-low-pressure heat exchanger that exchanges heat between the zeotropic refrigerant mixture on an upstream side of the decompression mechanism and the zeotropic refrigerant mixture on a downstream side of the decompression mechanism, wherein the first temperature sensor is arranged on the upstream side of the decompression mechanism and the second temperature sensor is arranged on the downstream side of the decompression mechanism, the pressure sensor is arranged on the downstream side of the decompression mechanism, and the detection control unit calculates the circulation composition value $\alpha^{cal}$ of the zeotropic refrigerant mixture, based on a state of the zeotropic refrigerant mixture on the downstream side of the decompression mechanism.

9. The refrigeration cycle device of claim 4, wherein the detection control unit sets an assumed value $\alpha$ of the circulation composition value of the zeotropic refrigerant mixture, calculates a refrigerant quality, based on the detected temperature value of the zeotropic refrigerant mixture on the inlet side detected by the first temperature sensor, the detected pressure value of the zeotropic refrigerant mixture on the outlet side detected by the pressure sensor, and the assumed value $\alpha$ of the circulation composition value of the zeotropic refrigerant mixture, calculates a circulation composition value $\alpha'$ of the zeotropic refrigerant mixture, based on the detected temperature value of the zeotropic refrigerant mixture on the outlet side detected by the second temperature sensor, the detected pressure value of the zeotropic refrigerant mixture on the outlet side detected by the pressure sensor, and the refrigerant quality, and sets the assumed value $\alpha$ of the circulation composition value of the zeotropic refrigerant mixture to the circulation composition value $\alpha^{cal}$ of the zeotropic refrigerant mixture where the assumed value $\alpha$ of the circulation composition value of the zeotropic refrigerant mixture matches the circulation composition value $\alpha'$ of the zeotropic refrigerant mixture.

10. The refrigeration cycle device of claim 4, further comprising:

an accumulator that is connected between the evaporator and the compressor and accumulates an excess zeotropic refrigerant mixture of the zeotropic refrigerant mixture that circulates through the refrigeration cycle, wherein the detection control unit calculates the circulation composition value $\alpha^{cal}$ of the zeotropic refrigerant mixture where the zeotropic refrigerant mixture that circulates through the refrigeration cycle does not remain in the accumulator as a liquid refrigerant.

11. The refrigeration cycle device of claim 4, wherein the circulation composition value $\alpha^{cal}$ of the zeotropic refrigerant mixture has, as a lower limit, a filling composition of a zeotropic refrigerant mixture to be filled in the refrigeration cycle and, as an upper limit, a composition of the zeotropic refrigerant mixture obtained by adding 5 wt % to the filling composition.

12. The refrigeration cycle device of claim 4, wherein the detection control unit calculates the circulation composition value $\alpha^{cal}$ of the zeotropic refrigerant mixture every time the refrigeration cycle is activated or a predetermined period of time after the refrigeration cycle is activated.

13. The refrigeration cycle device of claim 4, wherein the correction control unit is configured to determine that the zeotropic refrigerant mixture has leaked, where a difference between the reference composition value $\alpha^*$ and the circulation composition value $\alpha^{cal}$ of the zeotropic refrigerant mixture is equal to or greater than a specific value.

14. A refrigeration cycle device that circulates a zeotropic refrigerant mixture through a refrigeration cycle in which a compressor, a condenser, an expansion valve, and an evaporator are connected by a refrigerant pipe, comprising:

a first temperature sensor that detects refrigerant temperature on an inlet side of a portion in which the zeotropic refrigerant mixture discharged from the compressor is in a two-phase gas-liquid state, thereby obtaining a detected temperature value;

a second temperature sensor that detects refrigerant temperature on an outlet side of the portion in which the zeotropic refrigerant mixture discharged from the compressor is in the two-phase gas-liquid state, thereby obtaining a detected temperature value;

a pressure sensor that detects a refrigerant pressure on the outlet side, thereby obtaining a detected pressure value; and a correction control unit configured to set at least one of output values of the detected temperature value of the zeotropic refrigerant mixture in the two-phase gas-liquid state on the outlet side detected by the second temperature sensor and the detected pressure value of the pressure of the zeotropic refrigerant mixture in the two-phase gas-liquid state detected by the pressure sensor to a sum of an estimated temperature value and a corrected temperature value or a sum of an estimated pressure value and a corrected pressure value derived from a reference composition value $\alpha$ and a circulation composition value $\alpha^{cal}$ of the zeotropic refrigerant mixture; and the detected temperature values of the zeotropic refrigerant mixture detected by the first and the second temperature sensors and the detected pressure value of the zeotropic refrigerant mixture detected by the pressure sensor.

* * * * *